US007931481B2

(12) United States Patent
Yamakami

(10) Patent No.: US 7,931,481 B2
(45) Date of Patent: Apr. 26, 2011

(54) BALANCED TRANSMISSION CONNECTOR

(75) Inventor: Tohru Yamakami, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/502,354

(22) Filed: Jul. 14, 2009

(65) Prior Publication Data

US 2010/0015856 A1 Jan. 21, 2010

(30) Foreign Application Priority Data

Jul. 17, 2008 (JP) ..... 2008-186475

(51) Int. Cl.
*H01R 12/00* (2006.01)

(52) U.S. Cl. ..... 439/79; 439/660

(58) Field of Classification Search ..... 439/79, 439/660

See application file for complete search history.

(56) References Cited

U.S. PATENT DOCUMENTS

| | | | | |
|---|---|---|---|---|
| 5,664,968 | A * | 9/1997 | Mickievicz | 439/607.1 |
| 6,123,586 | A * | 9/2000 | MacDougall | 439/701 |
| 6,537,086 | B1 * | 3/2003 | MacMullin | 439/79 |
| 7,175,446 | B2 * | 2/2007 | Bright et al. | 439/79 |
| 7,670,191 | B2 * | 3/2010 | Ortega et al. | 439/660 |
| 2009/0035964 | A1 * | 2/2009 | Yamamoto et al. | 439/79 |

FOREIGN PATENT DOCUMENTS

JP 2004-355819 12/2004

* cited by examiner

*Primary Examiner* — Michael C Zarroli
(74) *Attorney, Agent, or Firm* — IPUSA, PLLC

(57) ABSTRACT

A balanced transmission connector includes an insulation block including a contact connecting part for connecting with another connector at a front part of the insulation block and connecting with a substrate at a bottom part of the insulation block, a first signal contact including an upper contact portion projecting from the front of the insulation block and a first lead portion projecting from the rear of the insulation block and extending toward the substrate, a second signal contact including a lower contact portion projecting from the front of the insulation block and a second lead portion projecting from the rear of the insulation block and extending toward the substrate, retaining portions formed on a rear part of the insulation block retaining the first and second lead portions from both sides. The first and second lead portions extend substantially in parallel while maintaining a shortest distance with respect to the substrate.

5 Claims, 23 Drawing Sheets

BALANCED TRANSMISSION CONNECTOR

BACKGROUND OF THE INVENTION

1. Field of the Invention

The present invention generally relates to a balanced transmission connector. For example, a balanced transmission connector is configured to input/output signals by using balanced transmission with a pair of contacts arranged in parallel.

2. Description of the Related Art

As for methods of transmitting data, there is a typical data transmitting method using a single electric wire. Another method is a balanced transmission method using a pair of electric wires. With the balanced transmission method, positive (+) signals are transmitted simultaneously with negative (−) signals having the same size but different polarities as the positive signals. The balanced transmission method has an advantage of being less susceptible to noise compared to the typical data transmitting method and is widely used in fields of transmitting signals at high speed.

A balanced transmission connector includes plural pairs of contacts arranged in parallel and has each contact with a lead part connected to a substrate wherein each pair of contacts has an input signal contact and an output signal contact positioned one on top of the other (See, for example, Japanese Laid-Open Patent Publication No. 2004-355819).

Next, a configuration of a balanced transmission connector 50 of a related art example is described with reference to FIGS. 1 and 2. FIG. 1 is a perspective view of the balanced transmission connector 50 of the related art example. FIG. 2 is an exploded perspective view of the balanced transmission connector 50 of the related art example.

As illustrated in FIGS. 1 and 2, the balanced transmission connector 50 has an insulation block 60, pairs of contacts (contact pair) 80, and planar ground contacts 90 assembled thereto. The insulation block 60 is a molded component made of a synthetic resin material having an electrical insulating property. Each pair of contacts (contact pair) 80 is formed of first and second signal contacts 81-1, 81-2. The pair of first and second signal contacts 81-1, 81-2 and the ground contacts 90 are alternately arranged at predetermined intervals. Further, throughout the entire length of the first and second signal contacts 81-1, 81-2 (length of first and second signal contacts 81-1, 81-2 in Y2-Y1 direction), the pairs of first and second signal contacts 81-1, 81-2 are positioned between adjacent ground contacts 90.

The insulation block 60 includes a main body portion 61, supporting portions 62, 63 extending from the X1 and X2 sides of the main body portion 61 to the Y1 direction, a planar connector portion 64 projecting from the main body portion 61 to the Y2 direction (front direction), a position restricting portion 65 arranged between the supporting portions 62, 63 and projecting from the main body portion 61 to the Y1 direction (rear direction), and boss portions 66 arranged on corresponding bottom surfaces of the supporting portions 62, 63.

A bottom portion of the main body portion 61 is mounted on an upper surface of a substrate 30. The connector portion 64 is connected to a connection slot 21 of a balanced transmission connector 20.

Slits 70 and pairs of first and second tunnels 71, 72 are alternately formed at predetermined intervals in the main body portion 61. The slits 70 are formed in the main body portion 61 corresponding to the ground contacts 90, and the pairs of first and second tunnels 71, 72 are formed in the main body portion 61 corresponding to the pairs of first and second signal contacts 81-1, 81-2. Further, slits 73, upper grooves 74, and lower grooves (not illustrated) are formed in the connector portion 64. The slits 73 are formed in a manner continuing from the slits 70. The upper grooves 74 are formed continuing from the first tunnels 71. The lower grooves are formed continuing from the second tunnels 72. Further, slits 76, 77, and 78 are formed at a Y1 side edge of the position restricting portion 65.

The ground contact 90 includes a planar base portion 91, a ground contact portion 92 extending from the base portion 91 in the Y2 direction, and an L-shaped lead portion 93 extending from a Y1-Z2 edge of the base portion 91 in the Y1 direction.

The first signal contact 81-1 includes a base portion 82-1, a rod-like signal contact portion 83-1 projecting from the base portion 82-1 in the Y2 direction (front direction), a length adjustment portion 84-1 extending from the base portion 82-1 in a downward diagonal direction (direction between directions Y1 and Z2), a substantially L-shaped orthogonal lead portion 85-1 extending from a Y1 edge of the length adjustment portion 84-1, and a horizontal direction lead portion 86-1 extending from a Z2 edge of the orthogonal lead portion 85-1 in the Y1 direction (rear direction).

The second signal contact 81-2 includes a base portion 82-2, a signal contact portion 83-2, a length adjustment portion 84-2, an orthogonal lead portion 85-2, and a horizontal lead portion 86-2. The second signal contact 81-2 basically has the same shape as the first signal contact 81-1 except that the length adjustment portion 84-2 extends from a X1 edge part of the base portion 82-2 in an upward diagonal direction.

The ground contacts 90 and the first and second signal contacts 81-1, 81-2 are assembled to the insulation block 60 by being pressingly inserted from the Y1 direction (rear direction).

By pressingly inserting the ground contact 90 in the slit 70 from the ground contact portion 92, the base portion 91 is inserted through the slit 70 and positioned in the slit 73. A Z1 edge surface 92b and a Z2 edge surface of the ground contact portion 92 are exposed on the Z1, Z2 surfaces of the connector portion 64. Further, substantially half of a Y1 portion of the base portion 91 projects from the main body portion 61 in the Y1 direction (rear direction). Further, Z2 projecting portions 91*b*1 of the base portion 91 and the lead portions 93 are engaged in the slits 76. Accordingly, the positions of the lead portions 93 are restricted in the X1-X2 directions.

By pressingly inserting the first signal contact 81-1 in the tunnel 71 from the signal contact portion 83-1, the signal contact portion 83-1 is inserted through the tunnel 71 and positioned in the upper groove 74. The base portion 82-1 is positioned inside the tunnel 71. The signal contact portion 83-1 is exposed on a Z1 surface of the connector portion 64. The length adjustment portion 84-1, the orthogonal lead portion 85-1, and the horizontal lead portion 86-1 project in the Y1 direction (rear direction). Further, a portion of the lead portion 85-1 positioned closer toward the horizontal lead portion 86-1 engages the slit 77. Accordingly, the positions of the lead portions 86-1 are restricted in the X1-X2 directions.

The ground contact portions 92 and the pairs of signal contact portions 83-1, 83-2 are arranged at intervals p1. The lead portions 93, 86-1, and the 86-2 are aligned on a bottom surface (X-Y surface) of the insulation block 60.

The first and second signal contact portions 83-1, 83-2 are arranged in parallel in a vertical direction (Z1-Z2 direction) at the front and the inside of the balanced transmission connector 50 whereas the first and second signal contact portions 83-1, 83-2 are arranged in a manner slightly diverted in the horizontal direction (X1-X2) at the rear of the balanced transmission connector 50. Accordingly, the orthogonal lead portions 85-1, 85-2 of the first and second signal contact portions 83-1, 83-2 and the horizontal lead portions 86-1, 86-2 have different lengths. This results in a problem of changing the impedance characteristics.

With the balanced transmission connector 50, the entire length of the orthogonal lead portions 85-1, 85-2 and the horizontal lead portions 86-1, 86-2 becomes long because the horizontal lead portions 86-1, 86-2 are formed in a manner projecting rearward of the ground contacts 90. Thereby, more elements become subject to the change of impedance characteristics as the entire length of the orthogonal lead portions 85-1, 85-2 and the horizontal lead portions 86-1, 86-2 increases. As a result, a larger ground contact 90 would be required for preventing cross-talk between the orthogonal lead portions 85-1, 85-2 and the horizontal lead portions 86-1, 86-2.

SUMMARY OF THE INVENTION

The present invention may provide a balanced transmission connector that substantially eliminates one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by balanced transmission connector particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides a balanced transmission connector including an insulation block including a contact connecting part for connecting with another connector at a front part of the insulation block and connecting with a substrate at a bottom part of the insulation block, a first signal contact including an upper contact portion projecting from the front of the insulation block and a first lead portion projecting from the rear of the insulation block and extending toward the substrate, a second signal contact including a lower contact portion projecting from the front of the insulation block and a second lead portion projecting from the rear of the insulation block and extending toward the substrate, a pair of retaining portions formed on a rear part of the insulation block and retaining the first and second lead portions from both sides, wherein the first and second lead portions extend substantially in parallel while maintaining a shortest distance with respect to the substrate.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

First Embodiment

Figure 1:
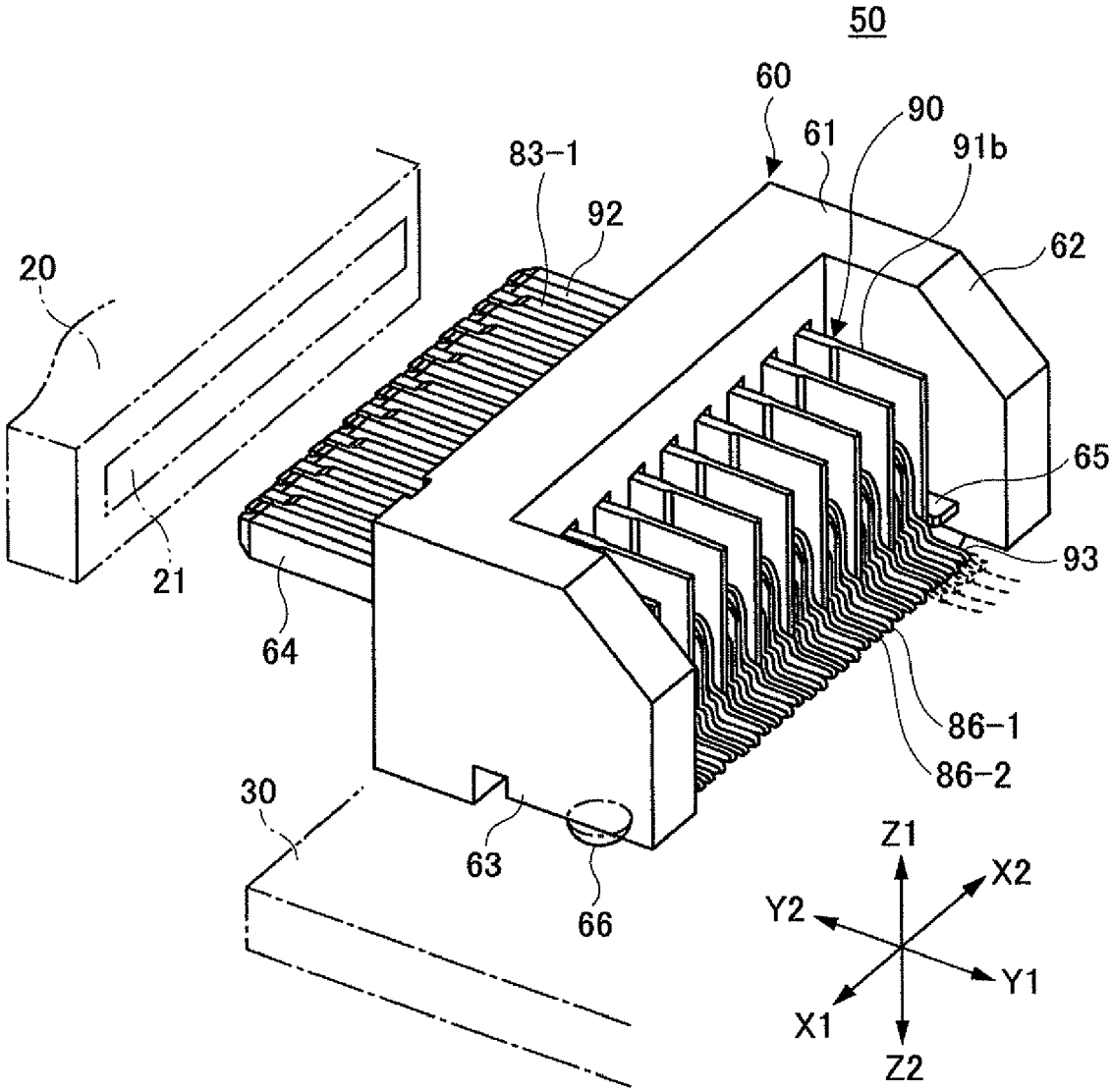
FIG.1 RELATED ART
FIG. 1 is a perspective view illustrating a configuration of a balanced transmission connector of a related art example.
Figure 2:
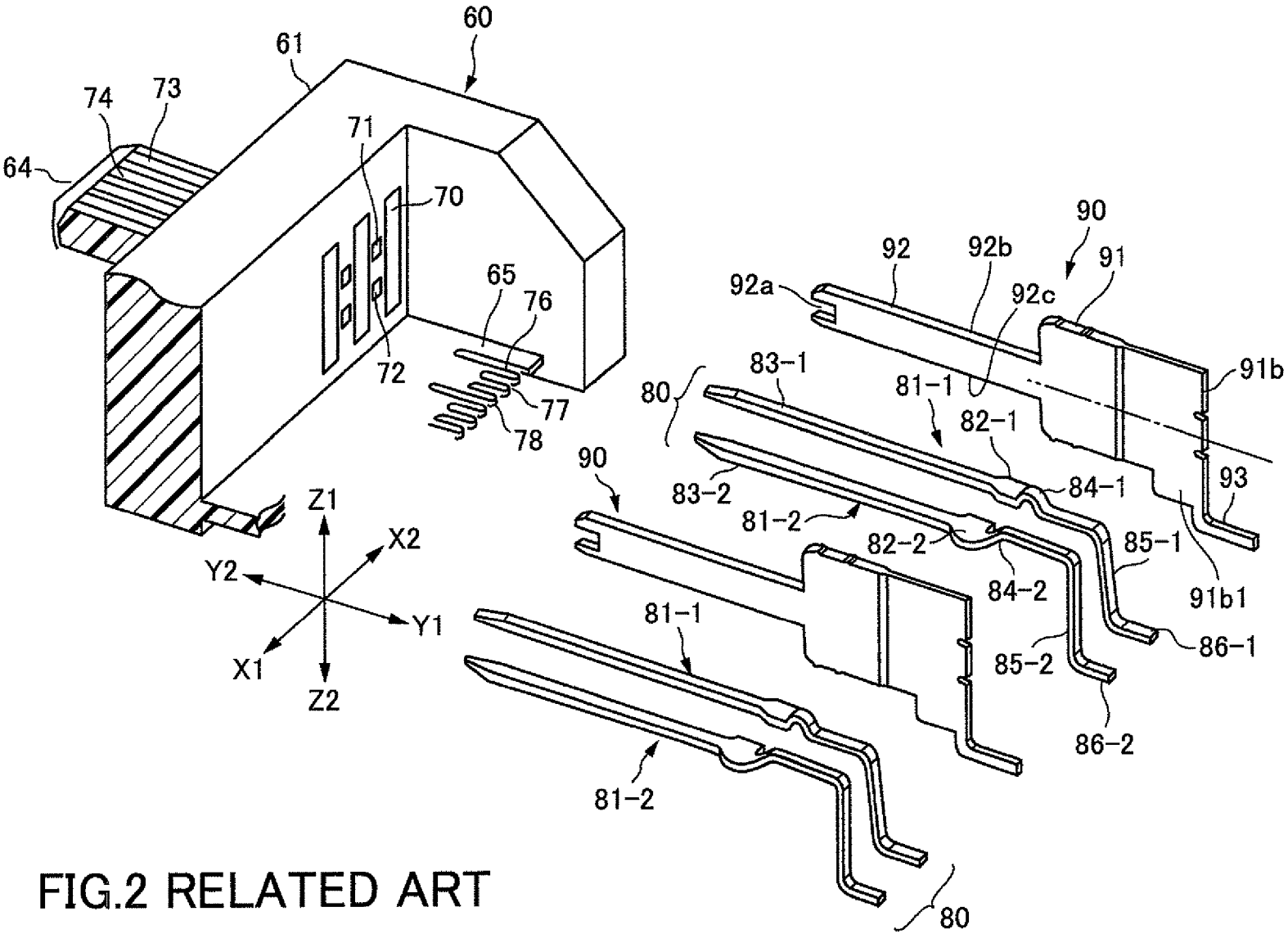
FIG.2 RELATED ART
FIG. 2 is an exploded perspective view of a balanced transmission connector of the related art example.
Figure 3:
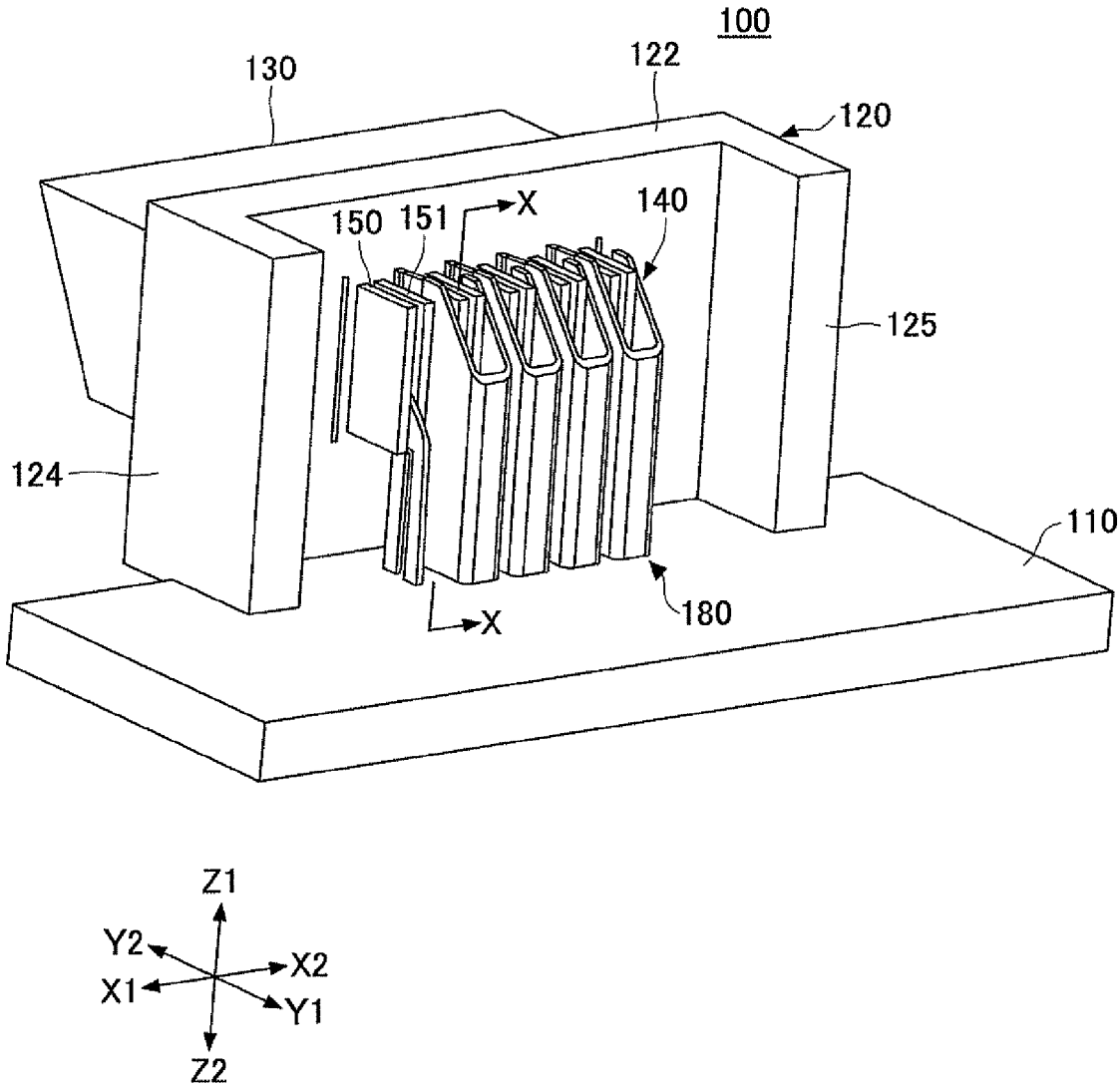
FIG. 3 is a perspective view of a balanced transmission connector according to a first embodiment of the present invention in a case where the balanced transmission connector is viewed from a diagonally upper side.
Figure 4:
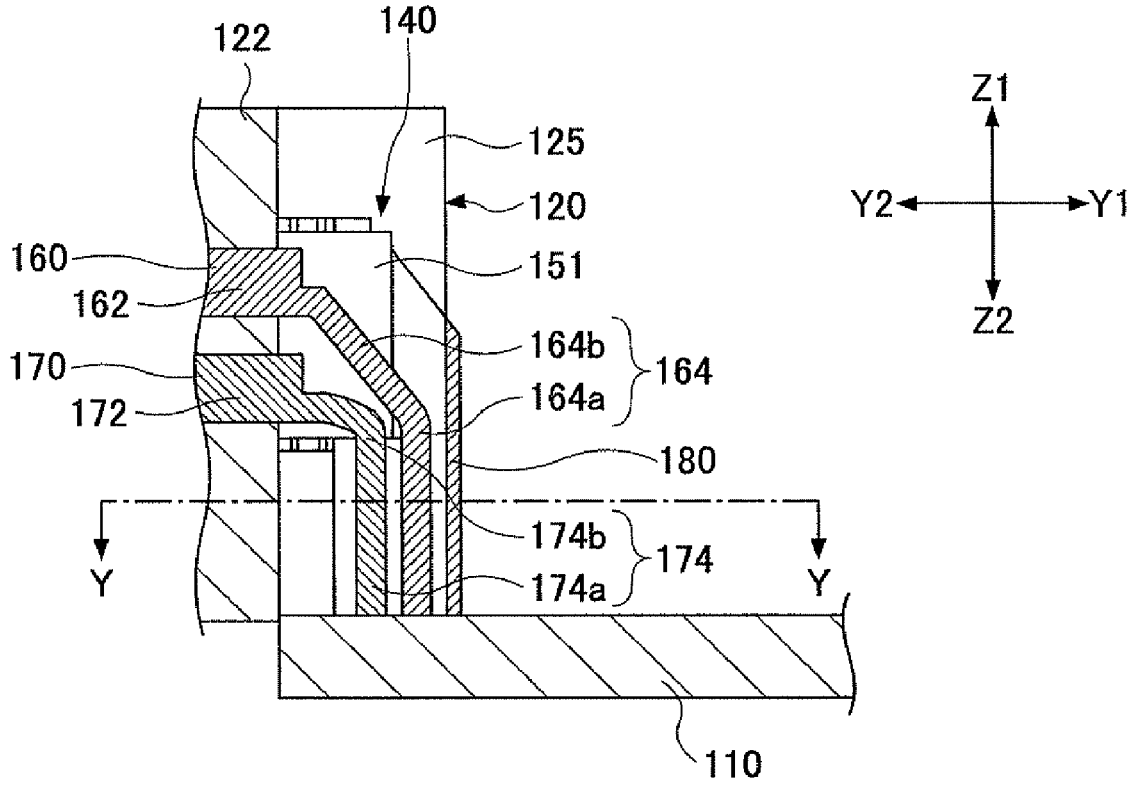
FIG. 4 is a vertical cross-sectional view of the balanced transmission connector taken along line X-X of FIG. 3.
Figure 5:
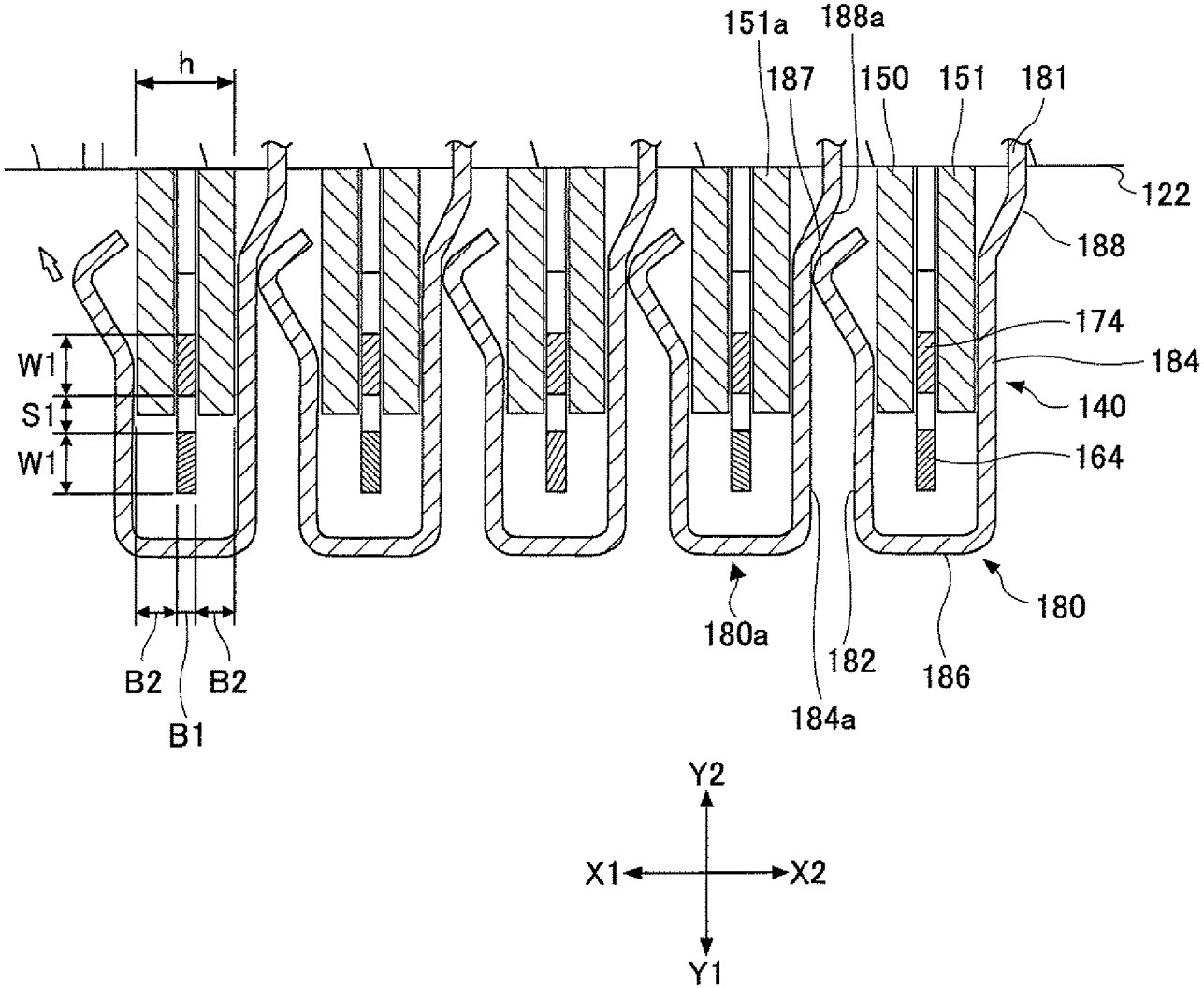
FIG. 5 is a horizontal cross-sectional view of the balanced transmission connector taken along line Y-Y of FIG. 3.

FIG. 3 is a perspective view of a balanced transmission connector 100 according to a first embodiment of the present invention in a case where the balanced transmission connector 100 is viewed from a diagonally upper side. FIG. 4 is a vertical cross-sectional view of the balanced transmission connector 100 taken along line X-X of FIG. 3. FIG. 5 is a horizontal cross-sectional view of the balanced transmission connector 100 taken along line Y-Y of FIG. 3.

As illustrated in FIGS. 3-5, the balanced transmission connector 100 includes an insulation block 120 mounted on a substrate 110, a connector connecting part 130 projecting from a front part (front side, that is, Y2 side) of the insulation block 120 in the Y2 direction, and plural substrate connecting parts 140 being formed at a rear part (rear side, that is, Y1 side) of the insulation block 120.

The insulation block 120 is formed into a closed bracket shape (when viewed from above) by molding an insulating resin material. The insulation block 120 includes a main body 122 supporting the connector connecting part 130, and a pair of side wall portions 124, 125 extending from X1, X2 sides (both sides) of the main body 122 in the Y1 direction (rear direction). One or more pairs of retaining portions 150, 151 are integrally molded to a Y1 side (rear side) of the main body 122 to form a united body with the insulating block 120. Each pair of the retaining portions 150, 151 is for supporting both sides of one set of the below-described first and second signal contacts 160, 170. The retaining portions 150, 151 are provided in a number corresponding to the number of first and second signal contacts 160, 170 to be inserted in the main body 122.

Each substrate connecting part 140 includes first and second signal contacts 160, 170 for transmitting/receiving balanced transmission signals and a ground connector 180 formed in a closed-bracket shape (when viewed from above) surrounding the first and second signal contacts 160, 170. In this embodiment, the first signal contact 160, the second signal contact 170, and the ground connector 180 are formed of a conductive metal material. Since a X1 side, a X2 side, and a Y1 side of the first and second signal contacts 160, 170 are covered by the ground contact 180, the first and second signal contacts 160, 170 surrounded by the ground contact 180 can be protected from cross-talk with other outside neighboring contacts.

The first signal contact 160 includes an upper contact portion 162 and a lead portion 164. One end of the upper contact portion 162 is to be inserted in an upper side of the connector connecting part 130. The lead portion 164 extends from the other end of the upper contact portion 162 in a downward direction. The other end of the upper contact portion 162 extends from a rear part (back surface) of the main body 122. The lead portion 164 extends from the rear part in a Z2 direction (downward direction) for connecting to a wiring pattern formed on the substrate 110.

The second signal contact 170 is provided directly below the first signal contact 160. The second signal contact 170 includes a lower contact portion 172 and a lead portion 174. One end of the lower contact portion 172 is to be inserted in a lower side of the connector connecting part 130. The other end of the lower contact portion 172 extends from the rear part (back surface) of the main body 122. The lead portion 174 also extends from the rear part in the Z2 direction (downward direction) for connecting to a wiring pattern formed on the substrate 10.

The upper contact portion 162 and the lower contact portion 172 are formed to have substantially the same shape and dimensions (measurements) with respect to the Y1, Y2, Z1, and Z2 directions, so that the upper and lower contact portions 162, 172 have the same impedance characteristics. Further, the lead portion 164 and the lead portion 174 are formed extending downward in parallel, where each have upper and lower ends. The distance from the upper end (Y2 end) to the lower end (Y1 end) of the lead portion 164 and hence to the substrate 110, and the distance from the upper end (Y2 end) to the lower end (Y1 end) of the lead portion 174 and hence to the substrate 110, become shortest, respectively. Thus, although the lead portions 164, 174 are formed with a straight portion 164*a*, 174*a* that have substantially the same shape and dimensions with respect to the Z1, Z2 directions, a curved portion 174*b* of the lead portion 174 is formed with a curve (inner curve) shorter than a curve (outer curve) of a curved portion 164*b* of the lead portion 164 in correspondence with the different radius of curvature of the curves.

Therefore, due to the difference of shape/dimensions of the curved portions 164*b*, 174*b*, it is difficult to match the impedance characteristics between the lead portions 164, 174. However, in this embodiment, by constraining the dimensions of the components of the balanced transmission connector 100 with use of the below-described formulas, the impedance characteristics of the lead portions 164, 174 can maintain a desired value.

Because the lead portions 164, 174 of the first and second signal contacts 160, 170 are formed to be relatively short, the ground connector facing both sides of the lead portions 164, 174 can be formed with a relatively small size. This contributes to size reduction of the substrate connecting part 140.

As illustrated in FIGS. 4 and 5, each of the lead portions 164, 174 is inserted between a pair of retaining portions 150, 151. Accordingly, by having both sides (X1, X2 sides) of the lead portions 164, 174 contact the inner walls of the pair of retaining portions 150, 151, the positions of the lead portions 164, 174 are regulated with respect to the X1, X2 directions.

Further, the ground connector 180 includes a ground connecting portion 181, a left side (first side) portion 182, a right side (second side) portion 184, and a connecting portion 186. The ground connecting portion 181 is inserted in an insertion slot of the insulation block 120, to thereby become exposed at the connector connecting portion 130. The left side portion 182 contacts an outer X1 (left) wall of the retaining portion 150 and faces the left sides of the first and second signal contacts 160, 170. The right side portion 184 contacts an outer X2 (right) wall of the retaining portion 151 and faces the right sides of the first and second signal contacts 160, 170. The connecting portion 186 connects the Y1 end portions of the left and right side portions 182, 184. The ground connecting portion 181, being inserted through the main body 122 and extending to the connector connecting portion 130, is formed continuing to the right side portion 184 of the ground connector 180. Further, the left side portion 182 of the ground connector 180 includes a pressing portion 187. The pressing portion 187 is formed by bending the left side portion 182 so that the pressing portion 187 is inclined from an outer wall of the retaining portion 150 in the X1 direction (towards the left side). The pressing portion 187 presses against the right side portion 184 of an adjacent ground connector 180*a* positioned on the X1 side (left side) of the ground connector 180.

Accordingly, the right side portion 184 of the adjacent ground connector 180*a* positioned on the X1 side can be retained by being pressed against the outer wall of the retaining portion 151*a* positioned on the X1 side. By providing an inclination portion 188 to the right side portion 184*a* in close proximity with the outer wall of the retaining portion 150, the pair of retaining portions 150, 151 can be sandwiched (held) closely to each other in the X1, X2 directions by the left and right side portions 182, 184. Accordingly, the curved portions 164*b*, 174*b* of the lead portions 164, 174 inserted between the pair of retaining portions 150, 151 can be sufficiently sandwiched (held) from both sides in the X1/X2 directions. Thus, the lead portions 164, 174 can be retained in a desired connecting position with respect to the substrate 110.

Because the ground connector 180 has the connecting part 186 connecting the left and right side portions 182, 184, the retaining portions 150, 151 can be held (sandwiched) on both sides. Thus, compared to separately providing the left and right side portions 182, 184, the number of components can be reduced. Thus, the work-load for assembly can be reduced.

The impedance characteristics of the dielectric formed by the pair of retaining portions 150, 151 and the lead portions 164, 174 (taken along line Y-Y of are defined according to the dielectric constant ∈ of the base material of the retaining portions 150, 151, the length w1 of the lead portions 164, 174 in the Y1, Y2 directions, a space s1 in the Y1, Y2 directions, the thickness of each of the retaining portions 150, 151, and a space B1 between the retaining portions 150, 151.

Figure 6:
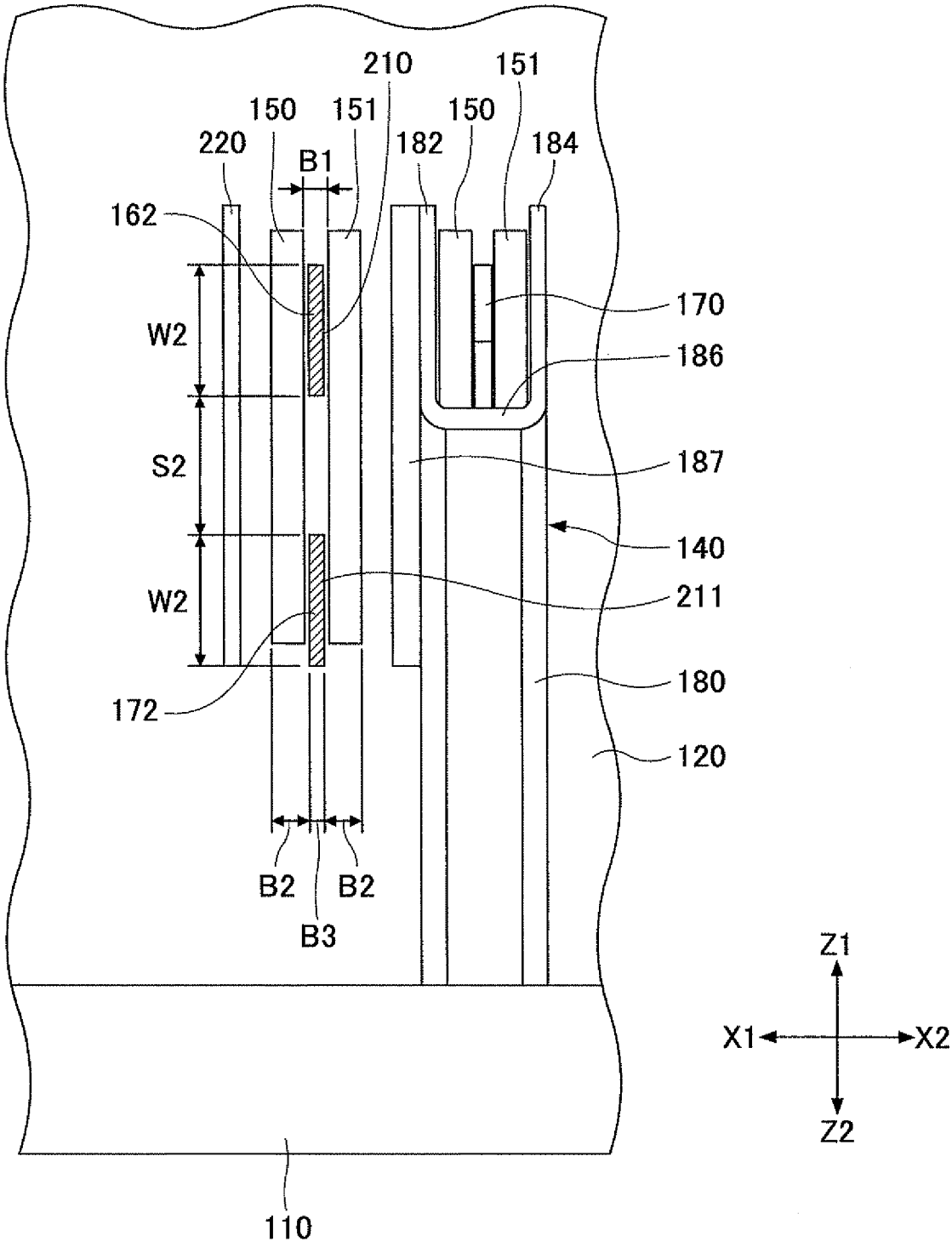
FIG. 6 is a schematic diagram illustrating a portion of an insulation block according to an embodiment of the present invention in a case where the insulation block is viewed from the rear side.

FIG. 6 is a schematic diagram illustrating a portion of the insulation block 120 according to an embodiment of the present invention in a case where the insulation block 120 is viewed from the rear side. As illustrated in FIG. 6, a pair of connector insertion slots 210, 211 is formed by penetrating the main body 122 in the Y1-Y2 directions at an area in between a pair of retaining portions 150, 151. Further, a ground insertion slot 220 is formed by penetrating the main body 122 in the Y1-Y2 directions at an outer side of the pair of retaining portions 150, 151.

In this embodiment, the connector insertion slots 210, 211 are narrow slits extending in the Z1-Z2 directions. The connection slots 210, 211 are formed with a length of w2 and have the connector insertion slots 210 and 211 separated at a distance of B1 so that a desired impedance characteristic can be attained. Further, the width of the pair of connector insertion slots 210, 211 in the X1-X2 directions is substantially equal to the space (separated distance) B1 between the pair of retaining portions 150, 151.

The upper and lower contact portions 162, 172 inserted through the connector insertion slots 210, 211 have substantially the same length as the length of the pair of connection slots 210, 211. The space (separated distance) between the upper and lower contact portions 162, 172 in the Z1-Z2 directions is s2.

The length of the ground insertion slot 220 with respect to the Z1-Z2 directions is greater than the length of each of the retaining portions 150, 151 with respect to the Z1-Z2 directions.

The width B2 of each of the retaining portions 150, 151 with respect to the X1-X2 directions is greater than the width B3 of the ground insertion slot 220 with respect to the X1-X2 directions (B2>B3). The width h (see FIG. 5) of a base material of the retaining portions 150, 151 is the added total of the widths of the retaining portions 150, 151 (B2×2) and the space B1.

Each of the measurements of w1, w2, s1, and h is set so that the impedance characteristics between the upper contact portion 162 and the lower contact portion 172 becomes a desired value (e.g., 100 Ω).

The impedance characteristics of the dielectric formed by the pair of retaining portions 150, 151 and the first and second signal contacts 160, 170 can be obtained by using the below-described formulas.

The impedance equation of the substrate connecting portion 140 is related to both an even mode (Even-mode·$Z_{0e}$) and an odd mode (Odd-mode·$Z_{0o}$) The impedances of both the even mode and the odd mode are measured between the first and second signal contacts 160, 170 and the ground surface. "$Z_{0e}$" indicates the impedance that is generated in a case where the first and second signal contacts 160, 170 is +V with respect to the ground surface. "$Z_{0o}$" indicates the impedance that is generated in a case where the first signal contact 160 is +V and the second signal contact 170 is −V with respect to the ground surface. A difference signal is added between the first and second signal contacts 160, 170 and a voltage is generated between the first and second signal contacts 160, 170 as the configuration of the Odd-mode. The impedance regulated by the potential difference between the first signal contact 160 and the second signal contact 170 is the differential impedance.

First, a coefficient $k_{0'}$ of the upper contact portion 162, the lower contact portion 172, and the lead portions 164, 174 is obtained by assigning each of the measurements w1, w2, s1, s2, and h assigned to the following Formula 1.

[Formula 1]

$$k_0' = \tanh\left[\frac{\pi w}{2.0h}\right]\coth\left[\frac{\pi(w+s)}{2.0h}\right] \tag{1}$$

Then, a coefficient $k_0$ is obtained by assigning $k_{0'}$ to the following Formula 2.

[Formula 2]

$$k_0=(1-k_0'^2)^{1/2} \tag{2}$$

Then, the impedance $Z_{0o}$ is obtained by assigning the values of the coefficient $k_{0'}$, the coefficient $k_0$, and the dielectric constant ∈ of the base material to the following Formula 3.

[Formula 3]

$$Z_{0o} = \frac{\eta_0}{4.0\sqrt{\varepsilon_r}}\frac{K(k_0)}{K(k_0')} \tag{3}$$

Then, the differential impedance $Z_{diff}$ is obtained by assigning the impedance $Z_{0o}$ to the following Formula 4.

[Formula 4]

$$Z_{diff}=2\times Z_{0o} \tag{4}$$

In a case where the value of the differential impedance $Z_{diff}$ is desired to be set to, for example, 100Ω, the desired value (target value) of 100Ω can be obtained by adjusting the combinations of the measurements of w, sr and h when using the above-described Formulas 1-4.

In a similar manner, the measurements w, s, and h of the lead portions 164, 174 are set so that the differential impedance $Z_{diff}$ can be set to a desired value (target value). That is, by regulating each of the measurements w1, w2, s1, s2, and h of the lead portion 164, 174 for attaining a desired differential impedance, impedance characteristics can be prevented from changing at the curved portions 164*b*, 174*b* of the lead portions 164, 174.

Figure 7:
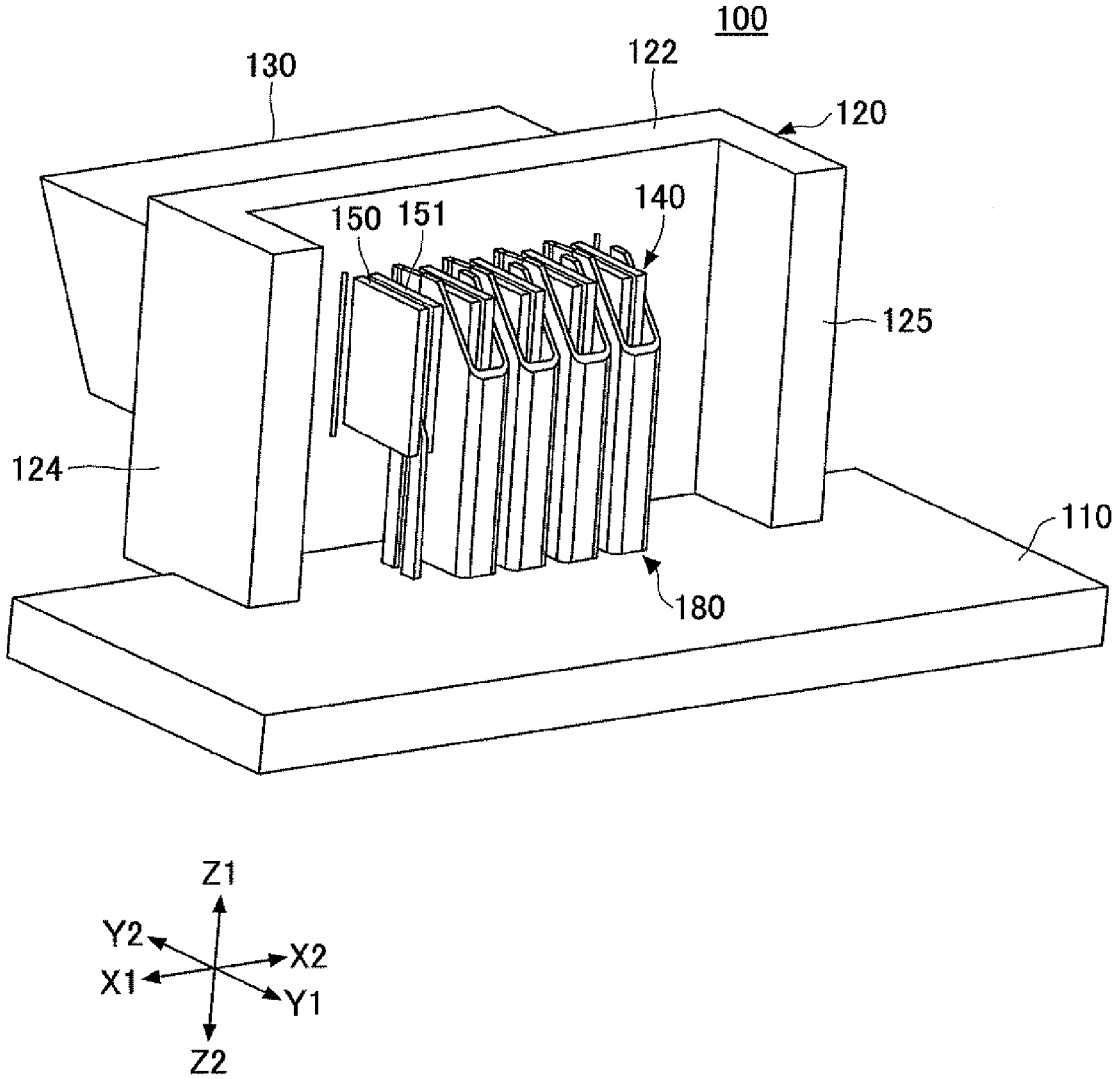
FIG. 7 is a perspective view of a balanced transmission connector according to a first modified embodiment in a case where the balanced transmission connector is viewed from a diagonally upper side.
Figure 8:
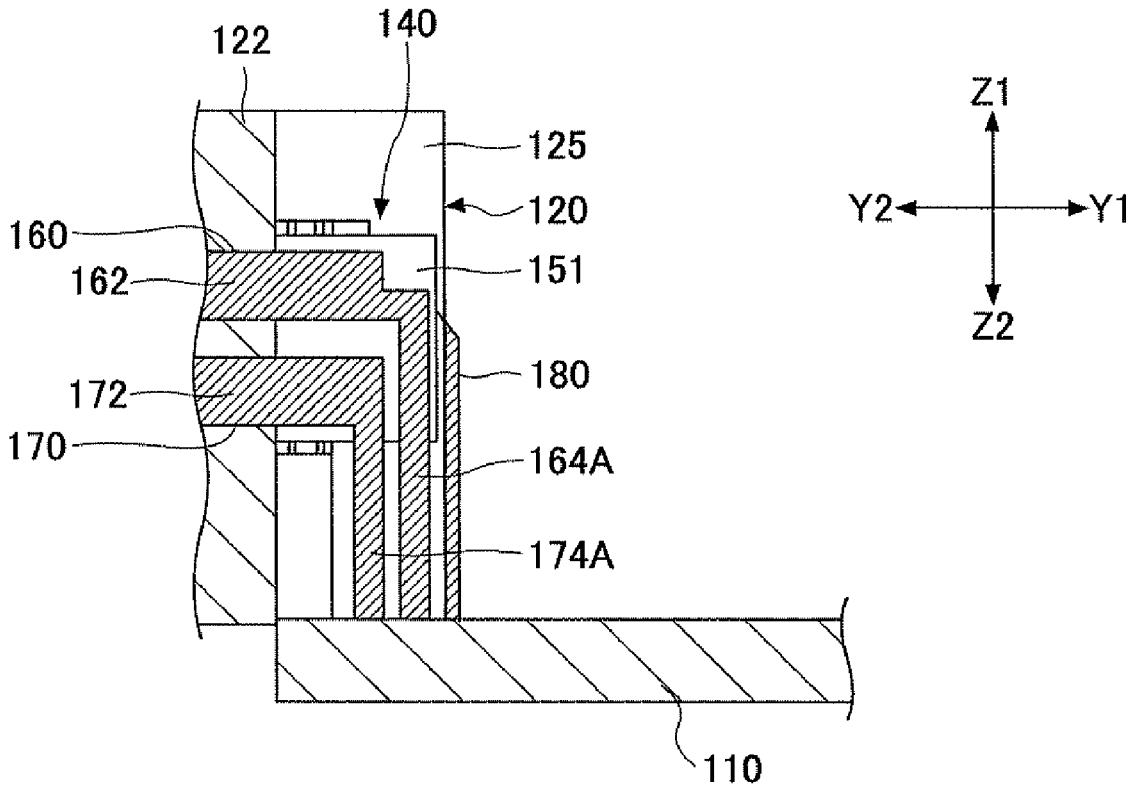
FIG. 8 is an enlarged vertical cross-sectional view of the balanced transmission connector of FIG. 7.

FIG. 7 is a perspective view of a balanced transmission connector 100 according to a first modified embodiment in a case where the balanced transmission connector 100 is viewed from a diagonally upper side. FIG. 8 is an enlarged vertical cross-sectional view of the balanced transmission connector 100 of FIG. 7. As illustrated in FIGS. 7 and 8, the lead portions 164A, 174A are formed with a straight portion extending downward in parallel so that the path from a predetermined part (e.g., the part of the lead portion 164 where the contact portion 162 projects from the wall of the main body 122 in the Y1 direction) to the substrate 110 and the path from a predetermined part (e.g., the part of the lead portion 174 where the contact portion 172 projects from the wall of the main body 122 in the Y1 direction) of the contact portion 172 to the substrate 110 become shortest, respectively. In this first modified example, the lead portions 164A, 174A are formed with a straight portion extending in the Z1-Z2 directions. Therefore, although the space between the lead portions 164A, 174A are constant, change of impedance characteristics may occur due to the difference of lengths of the lead portions 164A, 174A with respect to the Z1-Z2 directions.

However, even in the case of the first modified embodiment, the differential impedance $Z_{diff}$ can be set to a desired value (target value) by regulating the measurements w1, w2, s1, s2 and h of the lead portions 164A, 174A when using the Formulas 1-4. Thereby, impedance characteristics of the lead portions 164A, 174A can be prevented from changing due to difference in the lengths of the lead portions 164A, 174A.

Figure 9:
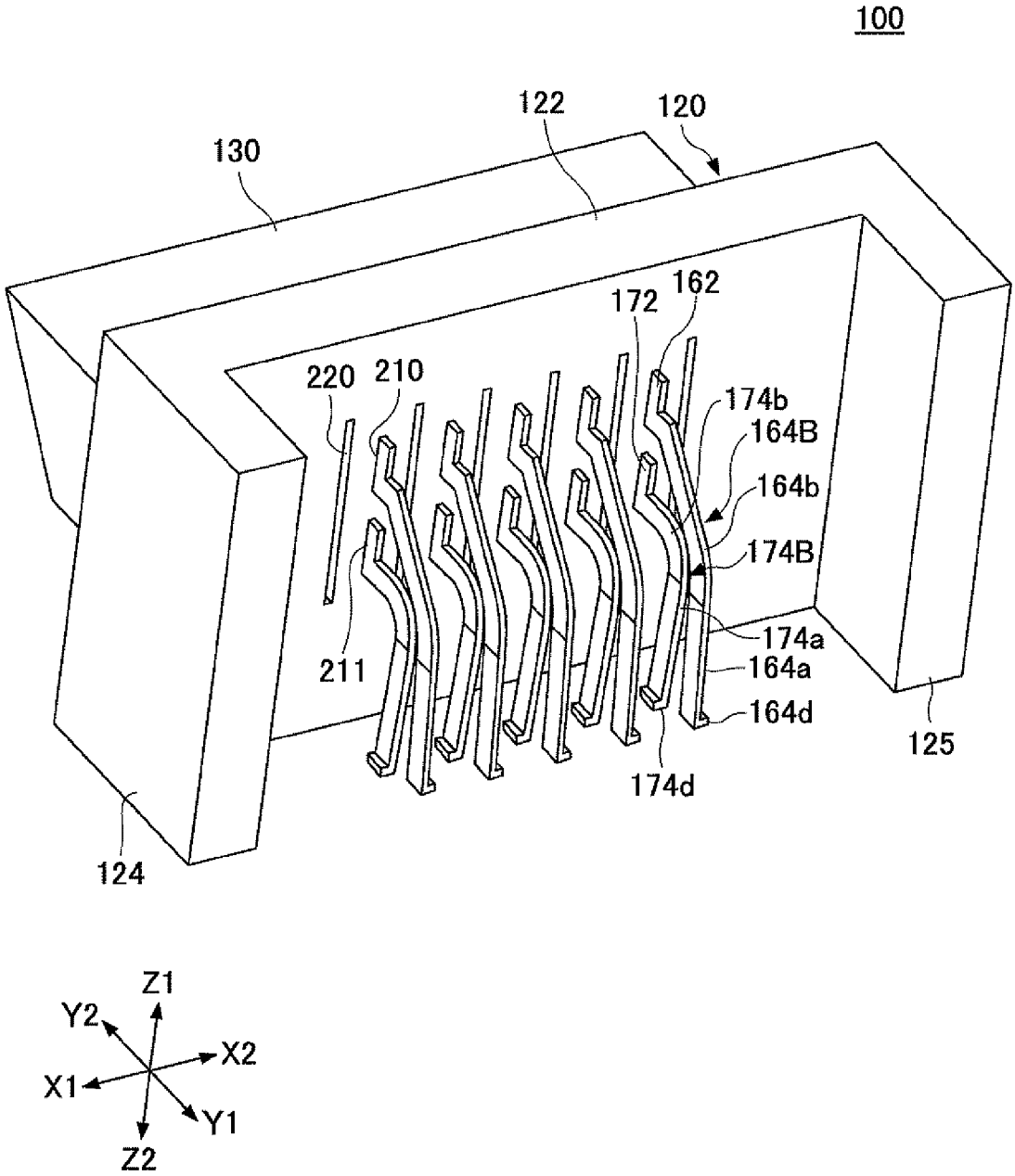
FIG. 9 is a perspective view illustrating lead portions according to a second modified embodiment in a case where the lead portions are viewed from a diagonally upper side.

FIG. 9 is a perspective view illustrating of lead portions 164B, 174B according to a second modified embodiment in a case where the balanced transmission connector 100 is viewed from a diagonally upper side. It is to be noted that the pair of retaining portions 150, 151 are not illustrated so that the shapes of the lead portions 164B, 174B are easier to view. As illustrated in FIG. 9, the lead portions 164B, 174B include straight portions 164*a*, 174*a* corresponding to upper leads and curved portions 164*b*, 174*b* corresponding to lower leads. The curved portions 164*b*, 174*b* are formed extending in a manner orthogonal to the end portions of the upper and lower contact portions 162, 172 so that the curved portions 164*b*, 174*b* are formed on the same plane as the end portions of the upper and lower contact portions 162, 172. The straight portions 164*a*, 174*a* are formed in a manner inclined at a predetermined angle with respect to a horizontal direction (X1-X2 direction) orthogonal to the curve portions 164*b*, 174*b*. The straight portions 164*a*, 174*a* have connecting portions 164*d*, 174*d* provided at their lower end sides, respectively. The connecting portions 164*d*, 174*d* are formed in a manner separated from each other in the X1-X2 directions. Accordingly, by separating the lower ends of the straight portions 164*a*, 174*a* in such manner, improved visibility can be attained when soldering the connecting portions 164*d*, 174*d* to the substrate 110 (not illustrated in FIG. 9 for the sake of convenience).

For example, the connecting portions 164*d*, 174*d* that are to be soldered to the substrate 110 may be formed by bending the lower ends of the straight portions 164*a*, 174*a* in an L-shape. Further, the connecting portion 164*d* is bent in the X2 direction and the connecting portion 174*d* is bent in the X1, so that the connecting portion 164 and the connecting portion 174 are separated in opposite directions. Thereby, cross-talk can be prevented and consistency of impedance characteristics can be attained. Further, the connecting portions 164d, 174*d* are formed having a wide soldering area with respect to patterns formed on the substrate 110. Accordingly, such wide soldering area increases the bonding strength with respect to the substrate 110.

Figure 10:
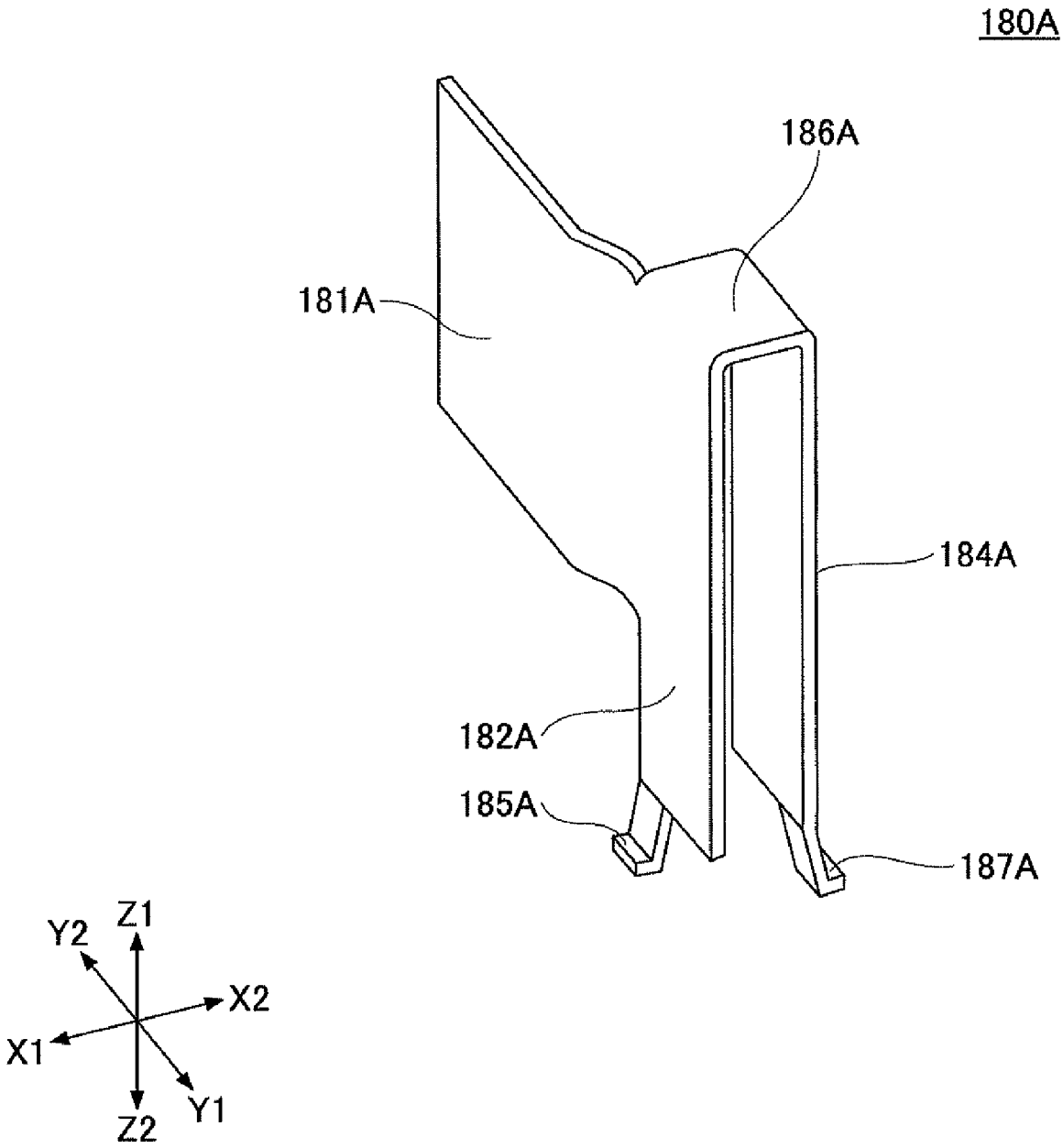
FIG. 10 is a perspective view of a ground connector according to a second modified embodiment in a case where the ground connector is viewed from a diagonally upper side.

FIG. 10 is a perspective view of a ground connector 180A according to a second modified embodiment in a case where the ground connector 180A is viewed from a diagonally upper side. As illustrated in FIG. 10, the ground connector 180A includes a ground connecting portion 181A, a left side portion 182A, a right side portion 184A, and a connecting portion 186A. The ground connecting portion 181A is inserted in the ground insertion slot 220, to thereby become exposed at the connector connecting portion 130. The left side portion 182A contacts an outer X1 (left) wall of the retaining portion 150 of the left side (X1 side). The right side portion 184A contacts an outer X2 (right) wall of the retaining portion 151 of the right side. The connecting portion 186A connects an upper end of the left side portion 182A (Z1 end portion) and an upper end of the right side portion 184A (Z1 end portion).

Further, the ground connector 180A also has connecting portions 185A, 187A projecting downward from the lower ends of the left and right side portions 182A, 184A. The connecting portions 185A, 187A are to be soldered to patterns formed on the substrate 110. For example, the connecting portions 185A, 187A are bent in a manner separating from each other in a direction (X1-X2 directions) orthogonal to the extending direction of the connecting portions 185A, 187A. The connecting portions 185A, 187A are bent and separated in the X1-X2 directions; the connecting portions 164*d*, 174*d* are formed having a wide soldering area with respect to patterns formed on the substrate 110. Accordingly, such wide soldering area increases the bonding strength with respect to the substrate 110. Further, the connecting portions 185A, 187A are slightly diverted from each other in the Y1-Y2 directions.

Figure 11:
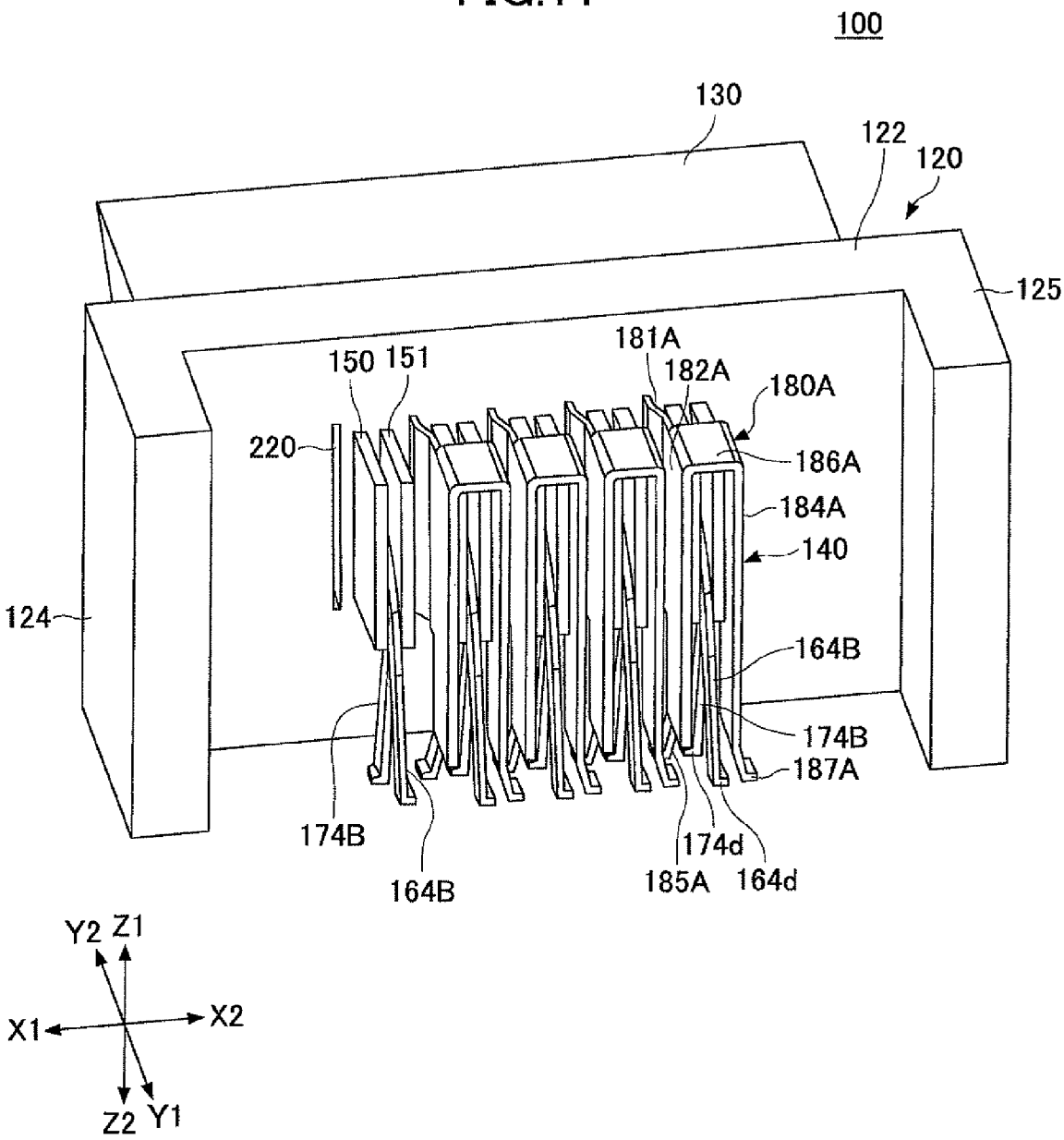
FIG. 11 is a perspective view illustrating an assembled state of a balanced transmission connector according to the second modified embodiment in a case where the balanced transmission connector is viewed from a diagonally upper side.
Figure 12:
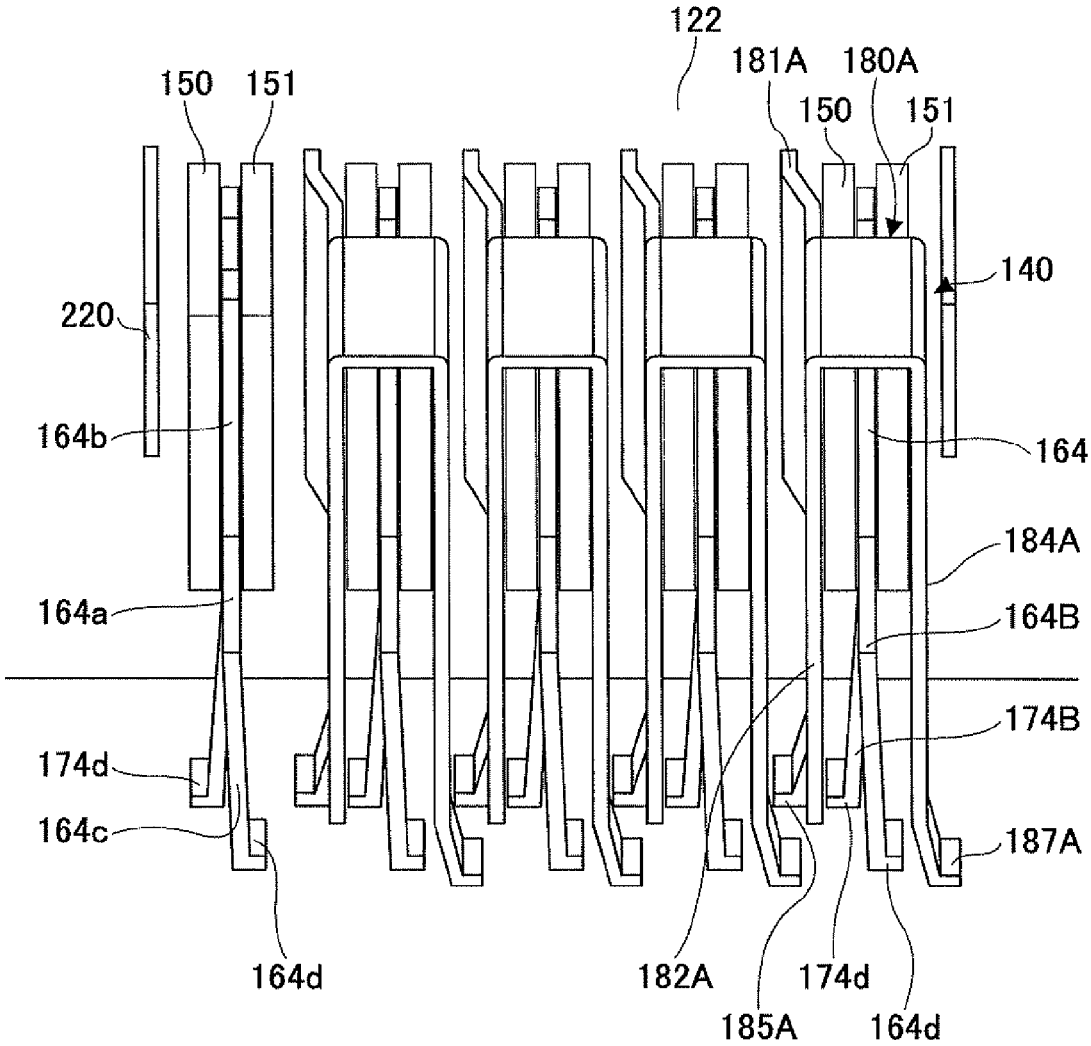
FIG. 12 is an enlarged perspective view of the assembled state of the balanced transmission connector according to the second modified embodiment in a case where the balanced transmission connector is viewed from a rear side.
Figure 12:
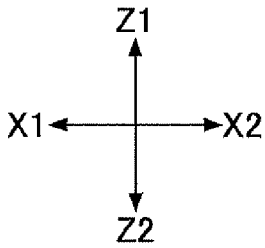

FIG. 11 is a perspective view illustrating an assembled state of the balanced transmission connector 100 according to the second modified embodiment in a case where the balanced transmission connector 100 is viewed from a diagonally upper side. FIG. 12 is an enlarged perspective view of the assembled state of the balanced transmission connector 100 according to the second modified embodiment in a case where the balanced transmission connector 100 is viewed from a rear side.

As illustrated in FIGS. 11 and 12, the lead portions 164B, 174B are inserted in a rear (rear surface) of the main body 122 between the retaining portions 150, 151. The lead portions 164B, 174B extend downward in parallel so that the distance in contacting the substrate 110 from predetermined ends of the lead portions 164B, 174B becomes shortest.

The outer sides of the retaining portions 150, 151 face the left and right side portions 182A, 184A of the ground connector 180A. In this assembled state illustrated in FIGS. 11 and 12, the connecting portions 164*d*, 174*d* of the straight portions 164*a*, 174*a* (see also FIG. 9) and the connecting portions 185A, 187A of the ground connector 180A are slightly deviated from each other with respect to the X1, X2 directions and the Y1, Y2 directions.

Accordingly, cross-talk between the connecting portions 164*d*, 174*d* can be prevented and consistency of impedance characteristics can be improved. Furthermore, in a case where plural substrate connecting parts 140 are formed in the main body 122, the soldering areas of the connecting portions 164*d*, 174*d* of the straight portions 164*a*, 174*a* and the connecting portions 185A, 187A of the ground connector 180A can be visually recognized. Further, since the connecting portions 164*d*, 174*d*, 185A, 187A are separated from each other in the X1, X2, Y1, and Y2 directions, solder bridges can be prevented from being formed during a reflow soldering process.

Figure 13:
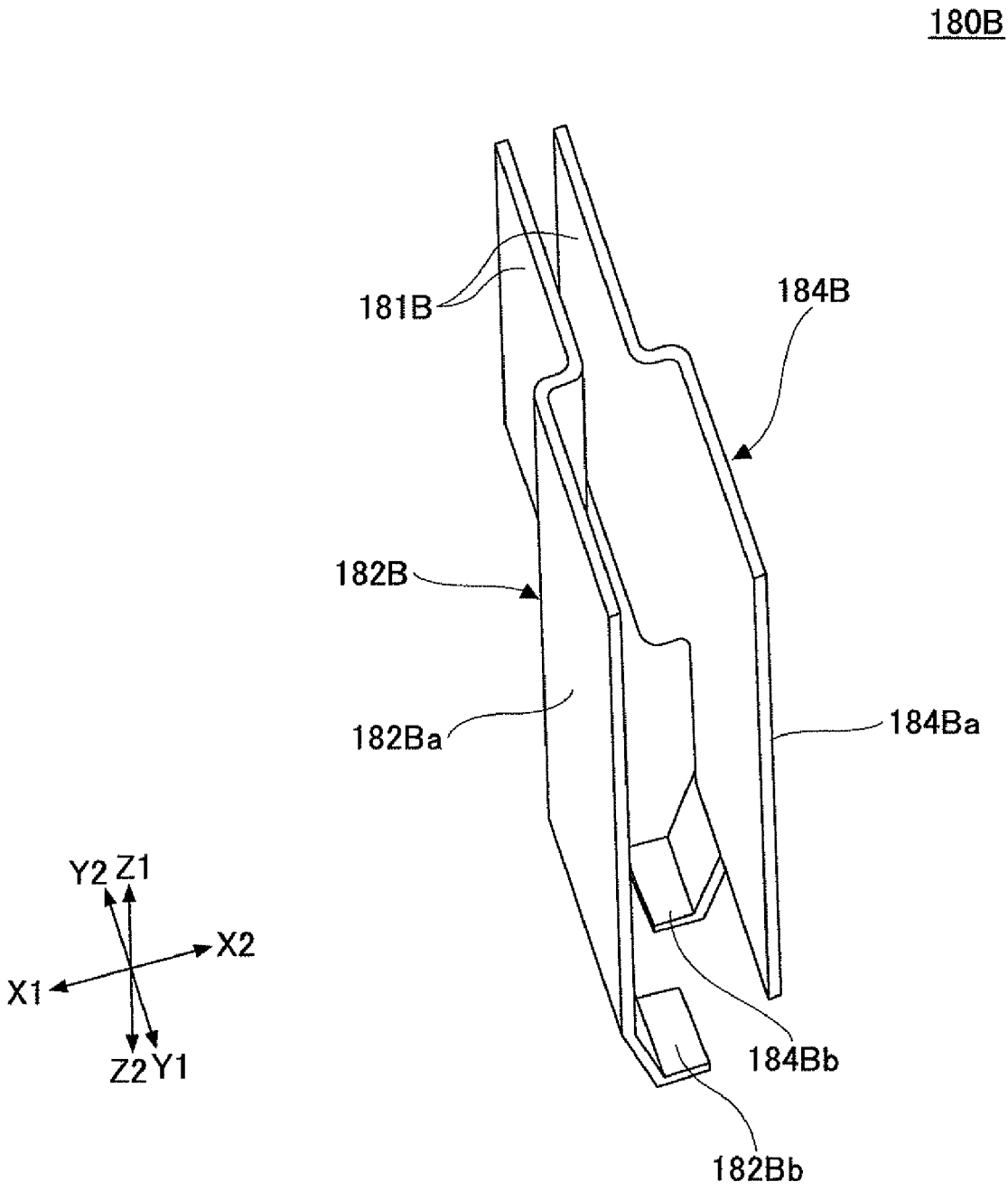
FIG. 13 is a perspective view illustrating a ground connector according to a third modified embodiment in a case where the ground connector is viewed from a diagonally upper side.

FIG. 13 is a perspective view illustrating a ground connector 180B according to a third modified embodiment in a case where the ground connector 180B is viewed from a diagonally upper side. As illustrated in FIG. 13, the ground connector 180B includes a left ground connector portion 182B contacting an outer wall of the retaining portion 150 toward the X1 direction and a right ground connector portion 184B contacting an outer wall of the retaining portion 150 toward the X2 direction. The left and right ground connector portions 182B, 184B are separated from each other and bent into a shape of crank when viewed from above. Further, the left ground connector portion 182B includes a ground connecting portion 181B, a contacting portion 182Ba, and a connecting portion 182Bb. The right ground connector portion 184B also includes the ground connecting portion 181B, a contacting portion 184Bar and a connecting portion 184Bb. The ground connecting portions 181B are inserted through corresponding ground insertion slots 220 and exposed at the connector connecting portion 130. The contacting portions 182Ba and 184Ba contact the outer walls of corresponding retaining members 150, 151. The connecting portions 182Bb, 184Bb extend from ends (Z2 end portions) of the contacting portion 182Ba, 184Ba and are soldered to a pattern formed on the substrate 110.

The left and right ground connectors 182B 184B are inserted through corresponding ground insertion slots 220 contacting the ground connecting portions 181B. Further, because the connecting portions 182Bb, 184Bb are bent in a manner separating from each other in X1, X2 directions, the connecting portions 182Bb, 184Bb can attain a wide area to which patterns on the substrate 110 are soldered. Owing to the wide area of the connecting portions 182Bb, 184Bb, the solder area with respect to the substrate 110 can be increased, thereby, greater bonding strength with respect to the substrate 110 can be attained. Further, the connecting portions 182Bb, 184Bb are positioned slightly deviated from each other in the Y1, Y2 directions.

Figure 14:
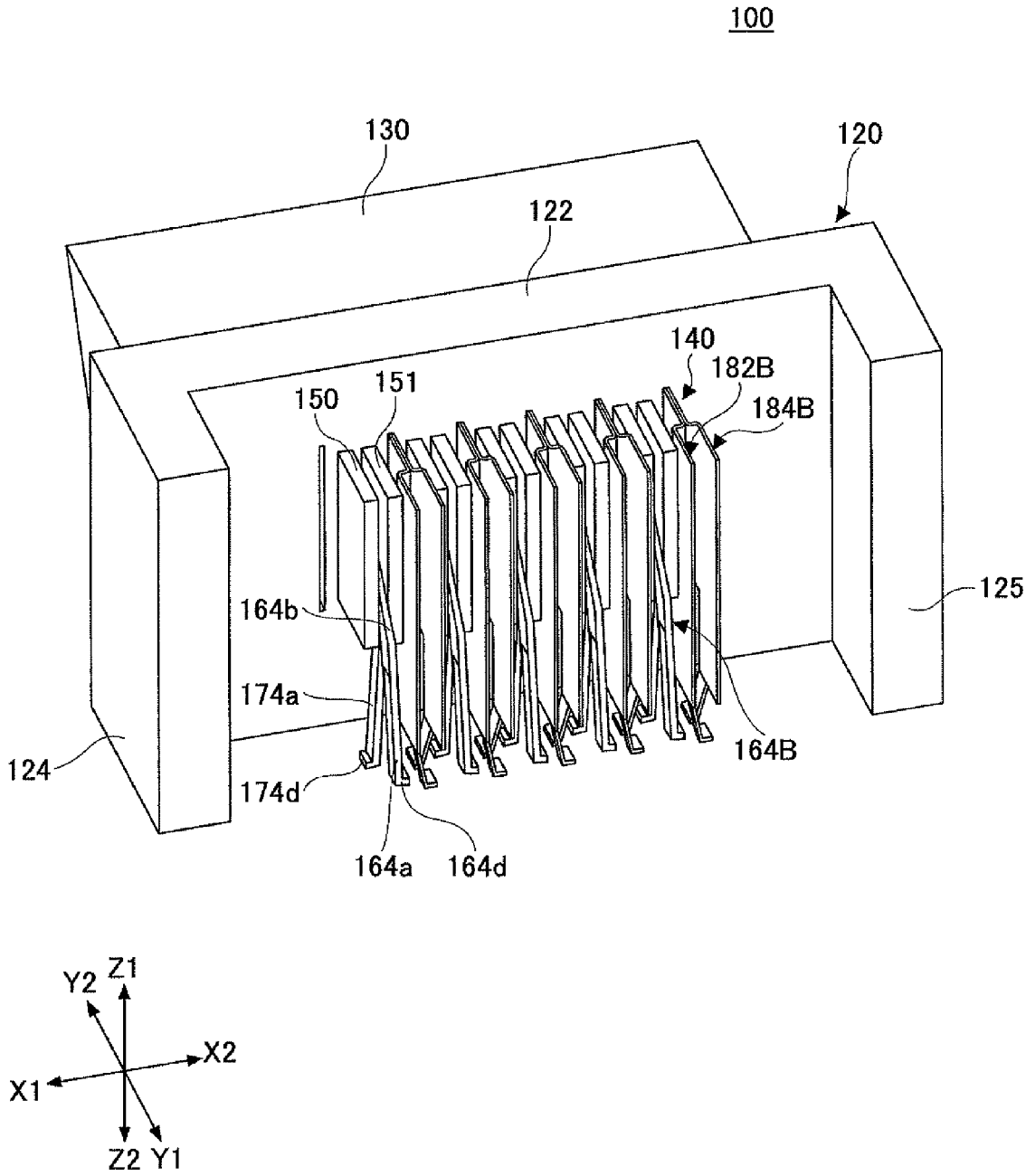
FIG. 14 is a perspective view illustrating an assembled state of the balanced transmission connector according to a third modified embodiment in a case where the balanced transmission connector is viewed from a diagonally upper side.
Figure 15:
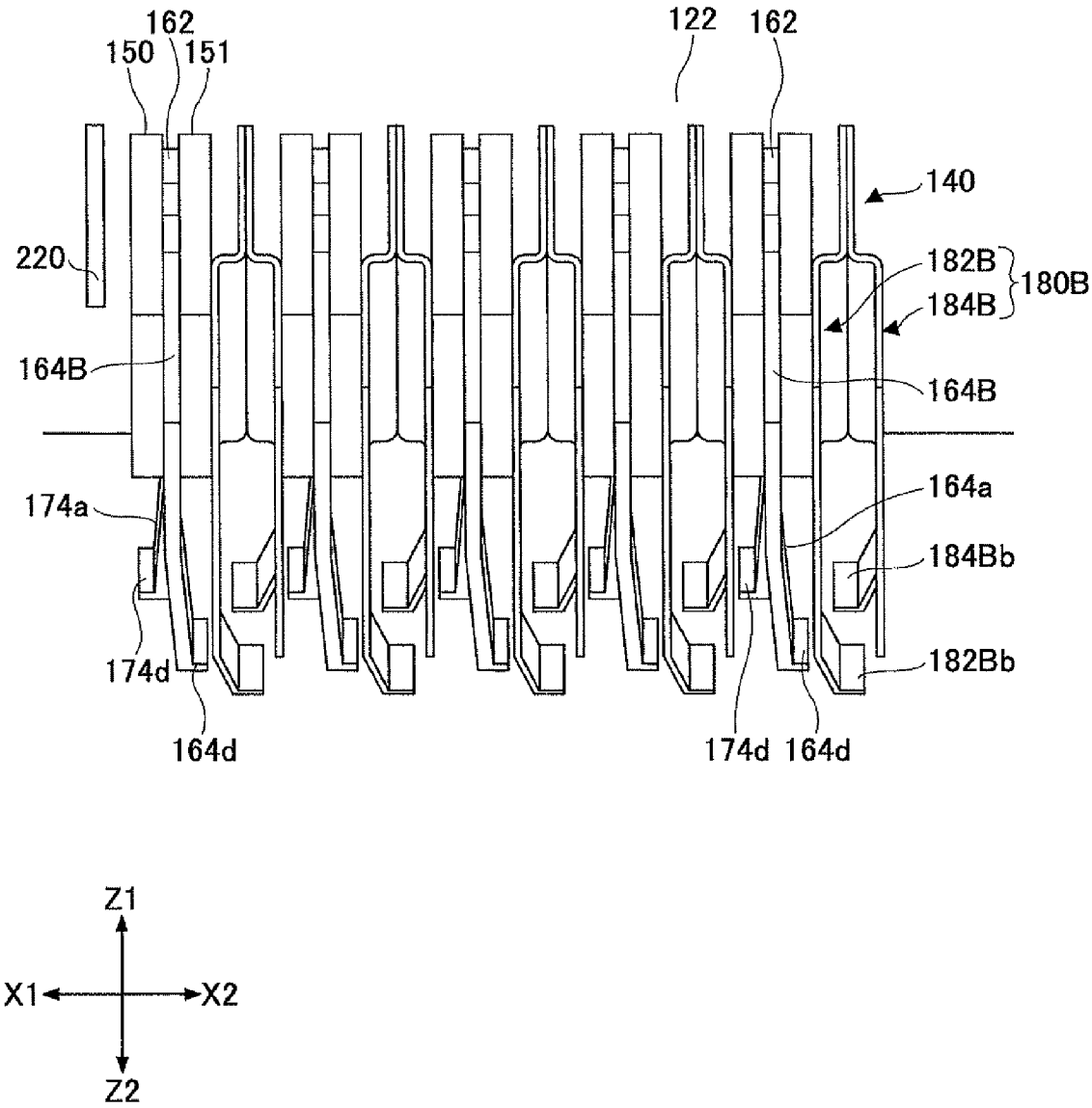
FIG. 15 is an enlarged perspective view of the assembled state of the balanced transmission connector according to the third modified embodiment in a case where the balanced transmission connector is viewed from a rear side.

FIG. 14 is a perspective view illustrating an assembled state of the balanced transmission connector 100 according to a third modified embodiment in a case where the balanced transmission connector 100 is viewed from a diagonally upper side. FIG. 15 is an enlarged perspective view of the assembled state of the balanced transmission connector 100 according to the third modified embodiment in a case where the balanced transmission connector 100 is viewed from a rear side.

As illustrated in FIGS. 14 and 15, the lead portions 164B, 174B are inserted in a rear (rear surface) of the main body 122 between the retaining portions 150, 151. The lead portions 164B, 174B extend downward in parallel so that the distance in contacting the substrate 110 from predetermined ends of the lead portions 164B, 174B becomes a minimum (e.g., shortest).

The outer sides of the retaining portions 150, 151 face the left and right side portions 182A, 184A of the ground connector 180A.

In this assembled state illustrated in FIGS. 14 and 15, the connecting portions 164*d*, 174*d* of the straight portions 164*a*, 174*a* and the connecting portions 182Bb, 1884Bb of the left and right ground connector portions 182B, 184B are slightly deviated from each other with respect to the X1, X2 directions and the Y1, Y2 directions.

Accordingly, cross-talk between the connecting portions 164*d*, 174*d* can be prevented and consistency of impedance characteristics can be improved. Furthermore, in a case where plural substrate connecting parts 140 are formed in the main body 122, the soldering areas of the connecting portions 164*d*, 174*d* of the straight portions 164*a*, 174*a* and the connecting portions 182Bb, 184Bb of the left and right ground connector portions 182B, 184B can be visually recognized. Further, since the connecting portions 164*d*, 174*d*, 182Bb, 184*bb* are separated from each other in the X1, X2, Y1, and Y2 directions, solder bridges can be prevented from being formed during a reflow soldering process.

Figure 16:
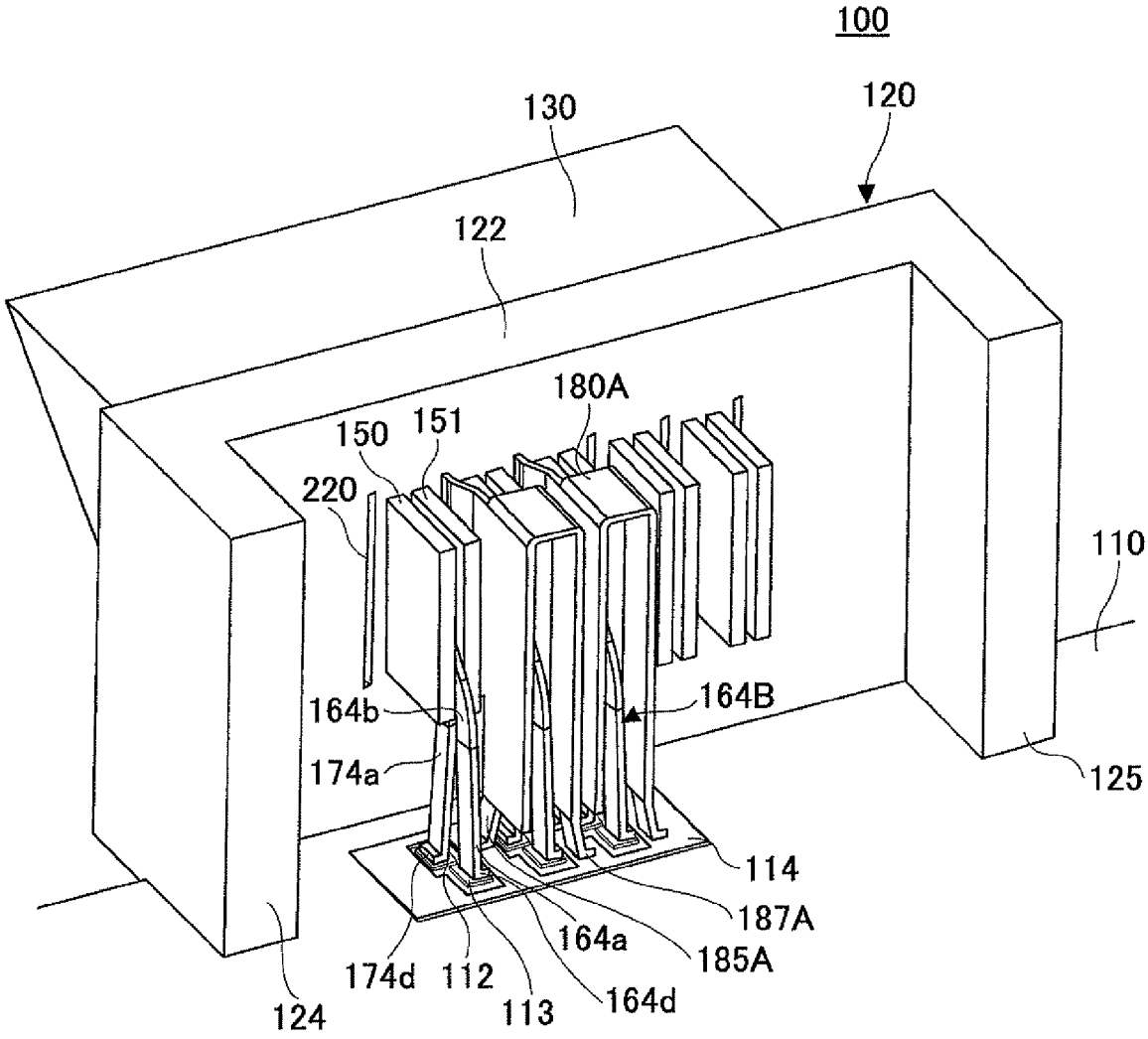
FIG. 16 is a perspective view illustrating a state of the balanced transmission connector of the second modified embodiment being mounted to the substrate in a case where the balanced transmission connector is viewed from a diagonally upper side.
Figure 17:
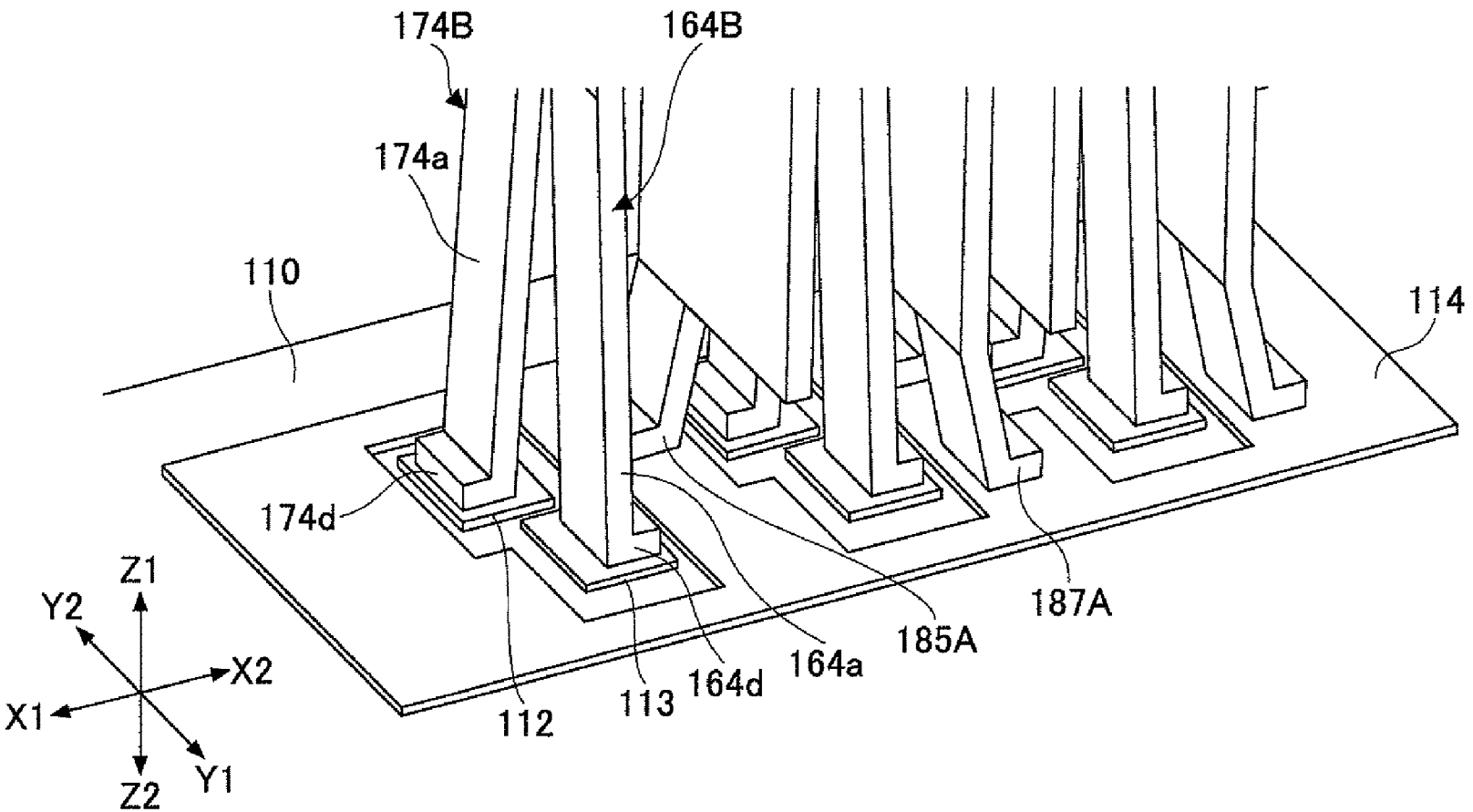
FIG. 17 is an enlarged perspective view of the mounted state of the balanced transmission connector of the second modified embodiment in a case where the balanced transmission connector is viewed from a rear side.

FIG. 16 is a perspective view illustrating a state of the balanced transmission connector 100 of the second modified embodiment (illustrated in FIG. 11) mounted to the substrate 110 in a case where the balanced transmission connector 100 is viewed from a diagonally upper side. FIG. 17 is an enlarged perspective view of the mounted state of the balanced transmission connector 100 of the second modified embodiment (illustrated in FIG. 11) in a case where the balanced transmission connector 100 is viewed from a rear side.

As illustrated in FIGS. 16 and 17, the connecting portions 164*d*, 174*d* of the straight portions 164*a*, 174*a* and the connecting portions 185A, 187A of the ground connectors 180A are soldered (e.g., by reflow soldering) to the wiring patterns 112 and ground patterns 114 formed on the upper surface of the substrate 110.

Figure 18:
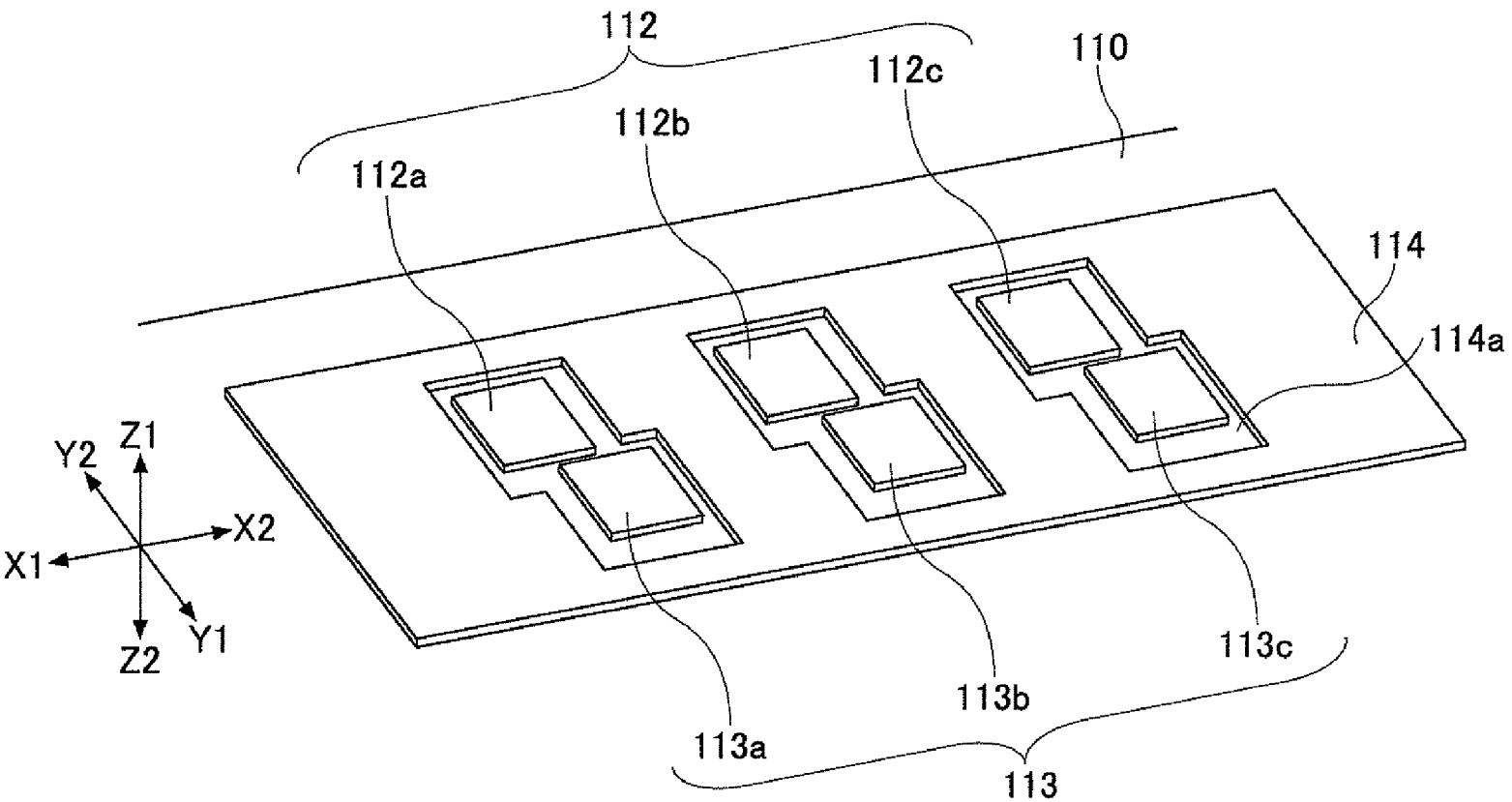
FIG. 18 is a perspective view illustrating wiring patterns and a ground pattern formed on a substrate according to an embodiment of the present invention.

FIG. 18 is a perspective view illustrating wiring patterns 112, 113 and a ground pattern 114 formed on the substrate 110 according to an embodiment of the present invention. As illustrated in FIG. 18, the wiring patterns 112, 113 include wiring pattern portions 112*a*, 113*a*, 112*b*, 113*b*, 112*c*, 113*c* formed on the substrate 110 in a manner deviated from each other in the X1, X2, Y1, and Y2 directions, so that the wiring pattern portions 112*a*, 113*a*, 112*b*, 113*b*, 112*c*, 113*c* correspond to the connecting portions 164*d*, 174*d* of the straight portions 164*a*, 174*a*. The ground pattern 114 includes ground pattern portions 114*a* formed in the substrate 114 in a manner surrounding the wiring pattern portions 112*a*, 113*a*, 112*b*, 113*b*, 112*c*, 113*c*. In this example, the ground portions 114*a* are formed as openings in which the wiring pattern portions 112*a*, 113*a*, 112*b*, 113*b*, 112*c*, 113*c* are provided therein.

Accordingly, even where the plural wiring pattern portions 112*a*, 113*a*, 112*b*, 113*b*, 112*c*, 113*c* are positioned proximal to each other, cross-talk between the wiring pattern portions 112*a*, 113*a*, 112*b*, 113*b*, 112*c*, 113*c* can be reduced.

Figure 19:
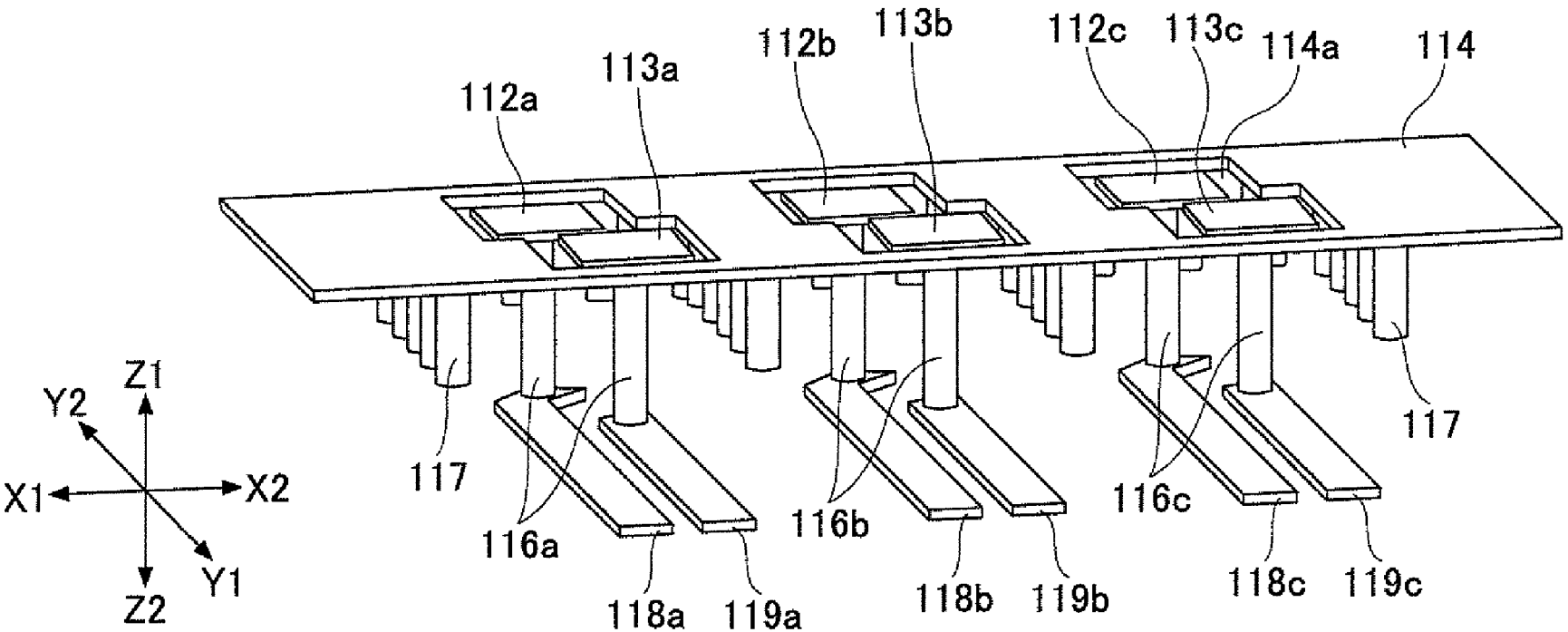
FIG. 19 is a perspective view illustrating wiring pattern portions to be formed on a substrate according to an embodiment of the present invention.

FIG. 19 is a perspective view illustrating the wiring pattern portions 112*a*, 113*a*, 112*b* r 113*b*, 112*c*, 113*c* to be formed on the substrate 110 according to an embodiment of the present invention. For the sake of convenience, the substrate 110 is not illustrated in FIG. 19.

As illustrated in FIG. 19, vias 116*a*-116*c*, which penetrate the substrate 110 in the Z1, Z2 directions, are formed below the wiring pattern portions 112*a*, 113*a*, 112*b*, 113*b*, 112*c*, 113*c*. The vias 116*a*-116*c* are formed by, for example, an electroplating method. Further, conductive patterns 11Sa, 119*a*, 118*b*, 119*b*, 118*c*, 119*c* are formed below the vias 116*a*-116*c*. Although the substrate 110 is not illustrated in FIG. 19, the conductive patterns 118*a*, 119*a*, 118*b*, 119*b*, 118*c*, 119*c* are provided in a middle layer of the substrate 110 with respect to the Z1-Z2 directions. Further, ground vias 117 are formed below the ground pattern 114 in a manner encompassing the vias 116*a*-116*c*. Thereby, cross-talk generated by the vias 116*a*-116*c* in the substrate 110 can be prevented.

Figure 20:
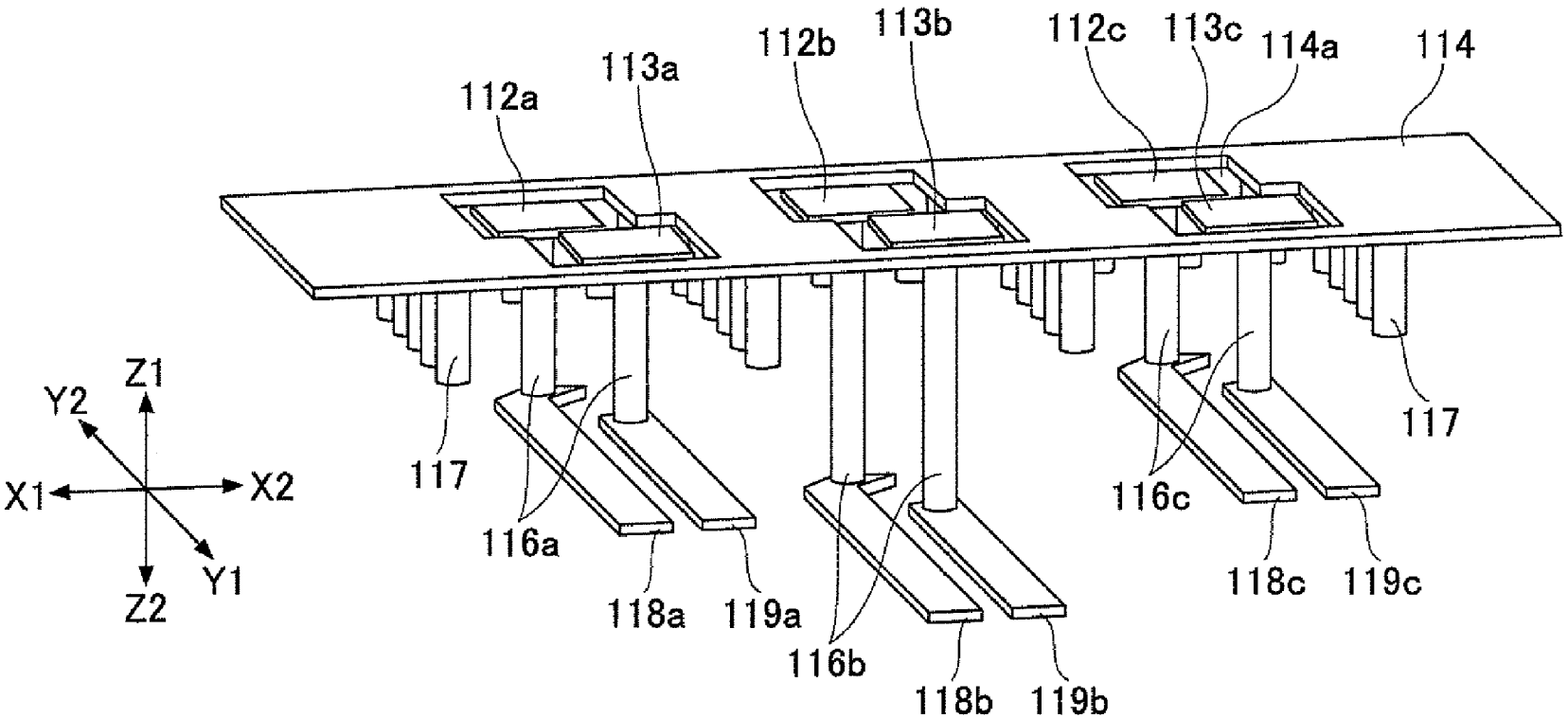
FIG. 20 is a perspective view illustrating wiring pattern portions to be formed on a substrate according to a modified embodiment of the present invention.

FIG. 20 is a perspective view illustrating the wiring pattern portions 112*a*, 113*a*, 112*b*, 113*b*, 112*c*, 113*c* to be formed on the substrate 110 according to a modified embodiment of the present invention. For the sake of convenience, the substrate 110 is not illustrated in FIG. 20.

As illustrated in FIG. 20, in a case where the wiring pattern portions 112*a*, 113*a*, 112*b*, 113*b*, 112*c*, 113*c* are formed proximal to each other, the vias 116*a*-116*c* may be formed having different lengths (length with respect to the Z1, Z2 directions). Accordingly, the conductive patterns 118*a*, 119, 118*b*, 119*b*, 118*c*, 119*c*, which are formed below the vias 116*a*-116*c*, can be deviated from each other in the Z1, Z2 directions (layered position inside the substrate 110). Accordingly, cross-talk between the conductive patterns 118*a*, 119, 118*b*, 119*b*, 118*c*, 119*c* can be reduced.

Figure 21:
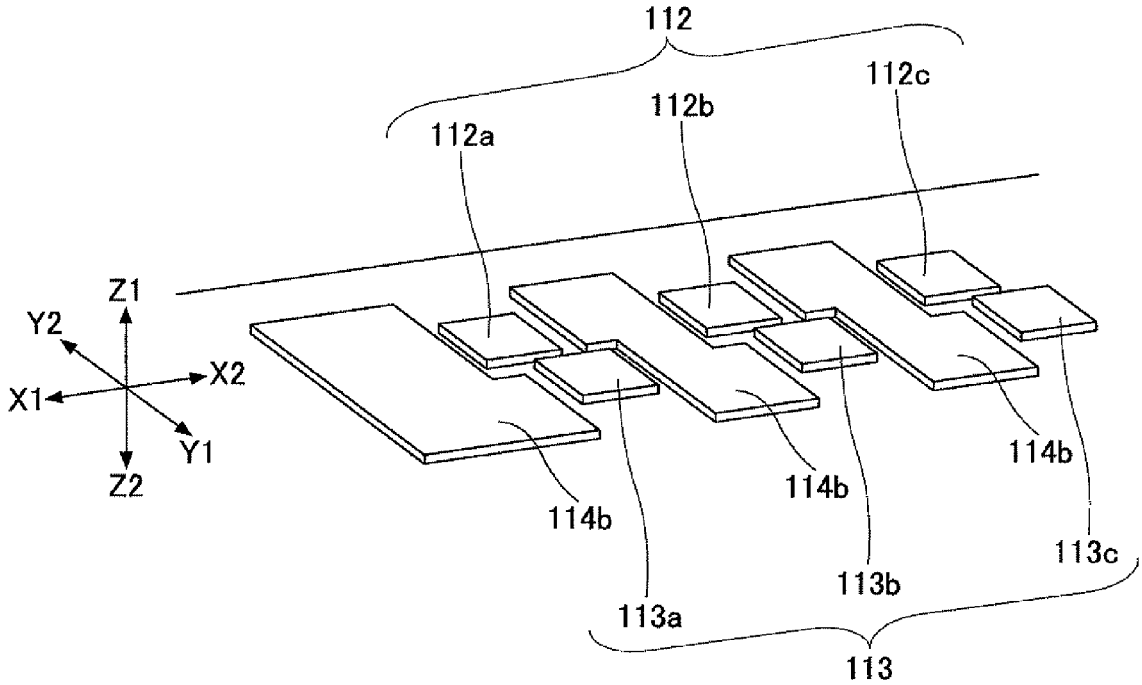
FIG. 21 is a perspective view illustrating wiring patterns and a ground pattern formed on a substrate according to a modified embodiment of the present invention.

FIG. 21 is a perspective view illustrating wiring patterns 112, 113 and a ground pattern 114 formed on the substrate 110 according to a modified embodiment of the present invention. As illustrated in FIG. 21, the wiring patterns 112, 113 include pairs of wiring pattern portions (112*a*, 113*a*), (112*b*, 113*b*), (112*c*, 113*c*) formed on the substrate 110 having ground pattern portions 114*b* arranged between the pairs. Accordingly, cross-talk between the pairs of wiring pattern portions (112*a*, 113*a*), (112*b*, 113*b*), (112*c*, 113*c*) is minimized or completely eliminated.

Figure 22:
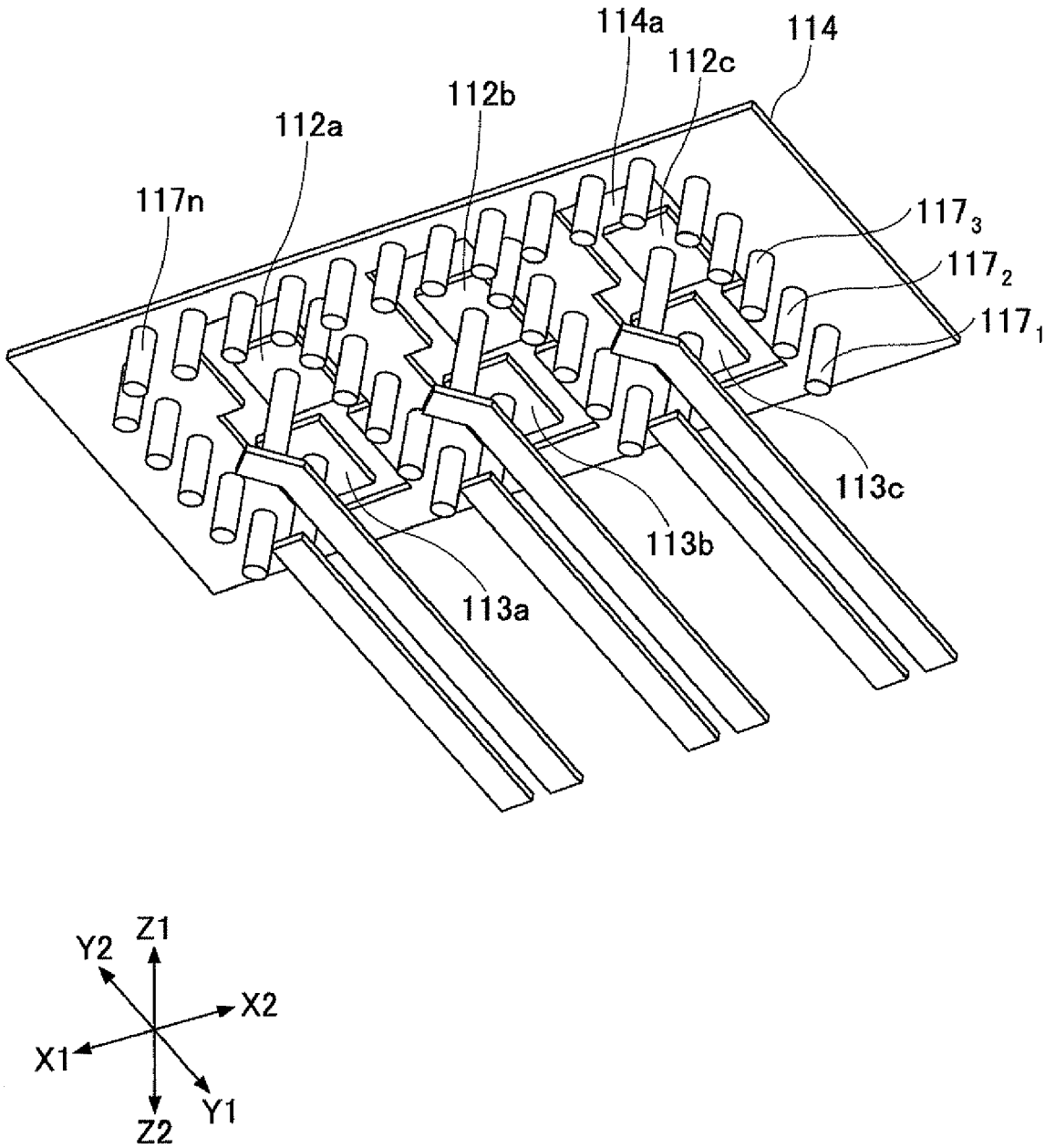
FIG. 22 is a perspective view illustrating ground vias formed on the substrate according to an embodiment of the present invention.

FIG. 22 is a perspective view illustrating ground vias 117 formed on the substrate 110 according to an embodiment of the present invention. For the sake of convenience, the substrate 110 is not illustrated in FIG. 22.

As illustrated in FIG. 22, plural vias $\mathbf{117}_1$ through 117*a* are connected to a bottom surface of the ground pattern 114. The vias $\mathbf{117}_1$ through $\mathbf{117}_n$ are arranged in predetermined intervals in a manner surrounding the opening portions (recessed portions), that is, the ground portions 114*a* of the ground pattern 114. Accordingly, cross-talk between the pairs of wiring patterns (112*a*, 113*a*), (112*b*, 113*b*), (112*c*, 113*c*), and the vias 116*a*-116*c* can be prevented.

Figure 23:
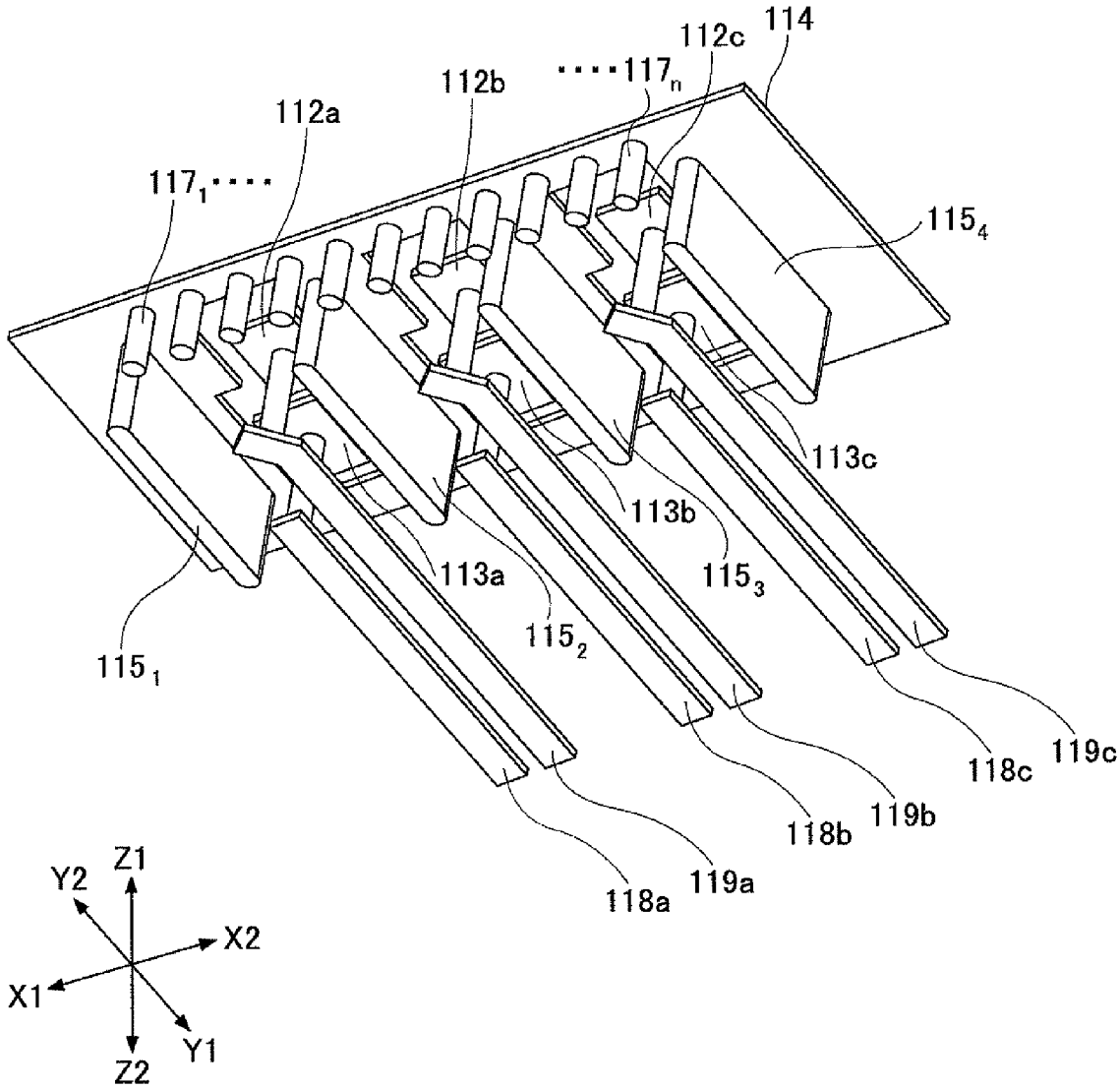
FIG. 23 is a perspective view illustrating ground vias formed on a substrate according to a modified embodiment of the present invention.

FIG. 23 is a perspective view illustrating ground vias 117 formed on the substrate 110 according to a modified embodiment of the present invention. For the sake of convenience, the substrate 110 is not illustrated in FIG. 23.

As illustrated in FIG. 23, plural vias $\mathbf{117}_1$ through $\mathbf{117}_n$ and wall-type vias $\mathbf{115}_1$ through $\mathbf{115}_n$ are connected to a bottom surface of the ground pattern 114. The vias $\mathbf{117}_1$ through $\mathbf{117}_n$ are aligned in the X1, X2 directions. In this example, the wall-type vias $\mathbf{115}_1$ through $\mathbf{115}_n$ are formed in elliptical shapes and extend in the Y1, Y2 directions. The plural vias $\mathbf{117}_1$ through $\mathbf{117}_n$ and wall-type vias $\mathbf{115}_1$ through $\mathbf{115}_n$ are arranged in predetermined intervals in a manner surrounding the opening portions (recessed portions), that is, the ground portions 114*a* of the ground pattern 114. Accordingly, cross-talk between the pairs of wiring patterns (112*a*, 113*a*), (112*b*, 113*b*), (112*c*, 113*c*), and the vias 116*a*-116*c* can be prevented.

Further, the present invention is not limited to these embodiments, but variations and modifications may be made without departing from the scope of the present invention.

The present application is based on Japanese Priority Application No. 2008-186475 filed on Jul. 17, 2008, with the Japanese Patent Office, the entire contents of which are hereby incorporated by reference.

What is claimed is:

1. A balanced transmission connector comprising:

an insulation block including a contact connecting part for connecting with another connector at a front part of the insulation block and connecting with a substrate at a bottom part of the insulation block;

a first signal contact including an upper contact portion and a first lead portion projecting from the rear of the insulation block and extending toward the substrate;

a second signal contact including a lower contact portion and a second lead portion projecting from the rear of the insulation block and extending toward the substrate;

a pair of retaining portions formed on a rear part of the insulation block and retaining the first and second lead portions from both sides; and a ground connector including one end connected to the contact connecting portion and the other end connected to the substrate wherein the ground connector has first and second side portions each facing the first and second signal contacts;

wherein the first and second lead portions have upper ends that establish a predetermined distance from the substrate;

wherein the first and second lead portions extend substantially in parallel; and whereby the predetermined distance is minimized.

2. The balanced transmission connector as claimed in claim 1, wherein the first and second lead portions are formed into a shape for attaining a desired impedance.

3. The balanced transmission connector as claimed in claim 1, wherein the first and second lead portions are inclined in directions separating from each other.

4. The balanced transmission connector as claimed in claim 1, wherein the first and second lead portions include solder connecting portions for connecting with the substrate.

5. The balanced transmission connector as claimed in claim 1, wherein the ground connector further includes a ground connecting portion for connecting with the substrate.

* * * * *